US009058782B2

(12) United States Patent
Fan et al.

(10) Patent No.: US 9,058,782 B2
(45) Date of Patent: Jun. 16, 2015

(54) DISPLAY DEVICE AND DRIVING METHOD THEREOF

(71) Applicant: AU Optronics Corporation, Hsin-Chu (TW)

(72) Inventors: Chen-Feng Fan, Hsin-Chu (TW); Chao-Wei Yeh, Hsin-Chu (TW); Chih-Hsiang Yang, Hsin-Chu (TW); Chien-Huang Liao, Hsin-Chu (TW); Wen-Hao Hsu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 185 days.

(21) Appl. No.: 13/919,081

(22) Filed: Jun. 17, 2013

(65) Prior Publication Data

US 2014/0192091 A1 Jul. 10, 2014

(30) Foreign Application Priority Data

Jan. 7, 2013 (TW) ..... 102100475 A

(51) Int. Cl.
*G09G 5/10* (2006.01)
*G09G 3/36* (2006.01)

(52) U.S. Cl.
CPC ..... *G09G 3/3607* (2013.01); *G09G 2300/0447* (2013.01); *G09G 2320/068* (2013.01)

(58) Field of Classification Search
None
See application file for complete search history.

(56) References Cited

U.S. PATENT DOCUMENTS

| | | | | |
|---|---|---|---|---|
| 6,285,431 | B2 | 9/2001 | Lyu et al. | |
| 6,646,707 | B2 | 11/2003 | Noh et al. | |
| 7,692,750 | B2 | 4/2010 | Jang et al. | |
| 2003/0058211 | A1* | 3/2003 | Kim et al. | 345/89 |
| 2007/0075950 | A1* | 4/2007 | Yamada et al. | 345/89 |
| 2007/0252801 | A1* | 11/2007 | Park et al. | 345/88 |
| 2010/0128189 | A1 | 5/2010 | Teranishi et al. | |
| 2010/0207862 | A1 | 8/2010 | Xu et al. | |
| 2010/0220043 | A1* | 9/2010 | Broughton et al. | 345/87 |
| 2010/0231544 | A1 | 9/2010 | Lu et al. | |
| 2011/0175936 | A1* | 7/2011 | Smith et al. | 345/690 |
| 2012/0280895 | A1 | 11/2012 | Yeh et al. | |
| 2012/0281174 | A1 | 11/2012 | Yeh et al. | |
| 2012/0293750 | A1 | 11/2012 | Yeh et al. | |
| 2013/0010219 | A1 | 1/2013 | Yeh et al. | |

FOREIGN PATENT DOCUMENTS

| | | |
|---|---|---|
| JP | 2007-178904 | 7/2007 |
| JP | 2007-178907 | 7/2007 |
| TW | 201025274 | 7/2010 |
| TW | 201245823 | 11/2012 |

* cited by examiner

*Primary Examiner* — Adam R Giesy
*Assistant Examiner* — Henok Heyi
(74) *Attorney, Agent, or Firm* — WPAT, PC; Justin King

(57) ABSTRACT

Disclosed herein is a display device with an adjustable viewing angle. The display device at least includes a first sub-pixel and a second sub-pixel adjacent to the first sub-pixel. When the display device is operated in a wide viewing angle mode, the first and second sub-pixels each have an on-axis brightness at a predetermined gray level. When the display device is operated in a narrow viewing angle mode, the first and second sub-pixels respectively have a on-axis brightness at a first gray level and a second on-axis brightness at a second gray level. The on-axis brightness at the first gray level is substantially less than the on-axis brightness at the predetermined gray level of the first sub-pixel.

22 Claims, 18 Drawing Sheets

DISPLAY DEVICE AND DRIVING METHOD THEREOF

RELATED APPLICATIONS

This application claims priority to Taiwan Application Serial Number 102100475, filed Jan. 7, 2013, which is herein incorporated by reference.

BACKGROUND

1. Technical Field

The present disclosure relates to a display device with an adjustable viewing angle and a method for driving the display device with an adjustable viewing angle.

2. Description of Related Art

Generally, a display device usually has a wide viewing angle for the purpose of allowing the image to be seen for a plurality of viewers. However, at some times or in some places, for example, when reading confidential information or inputting a password, the effect of the wide viewing angle easily causes the confidential information to be peeped by other people, which causes the divulgation of the confidential information. Therefore, in order to meet two different demands, both providing the image for a plurality of viewers and treating the confidential information in public places, the display device with an adjustable viewing angle, that is switchable between a wide viewing angle display mode and a narrow viewing angle display mode, gradually becomes one of mainstream products on the display device market.

A conventional anti-peep mechanism of a display device may be substantially classified into several techniques as below:

I. Direct Installation of an Anti-Peep Sheet on an External Surface of the Display Device:

A typical anti-peep sheet prevents the viewers in side view from clearly reading the displayed information by inhibiting the brightness at a large viewing angle, so as to achieve the privacy protection. Although this method is easy and the material of the anti-peep sheet is common, the additional installation of one optical film affects the original on-axis optical property and display quality of to the display device. Moreover, whether to prevent peep is manually switched, resulting in much inconvenience in use of a user.

II. Control of a Backlight Source

A backlight source that emits light with high collimation is utilized. The backlight source is equipped with a voltage-controlled diffusion sheet, for example a polymer-dispersed liquid crystal (PDLC) film. When the voltage applied to the diffusion sheet is turned off, the voltage-controlled diffusion sheet diffuses the collimated light and a portion of light is directed towards the side view, so that a wide viewing angle mode is realized. When the voltage applied to the diffusion sheet is turned on, the voltage-controlled diffusion sheet does not cause diffusion of the original collimated radiation, so that a narrow viewing angle mode is achieved. In this method, the brightness for the side view is adjusted by controlling the scattering angle of the backlight such that the people positioned at the side view cannot read the displayed information. Although ideally other people can be completely prevented from peeping at the information, and the switching between the wide viewing angle mode and the narrow viewing angle mode is convenient, completely collimated light, however, cannot be achieved in an actual application due to difficulties in controlling the light path. Even though the light distribution at a large viewing angle can be decreased, but the brightness towards the large viewing angle cannot be decreased to a level of unavailable identification. Therefore, a desirable anti-peep effect cannot be obtained.

III. Additional Arrangement of a Viewing Angle Control Module Unit

A viewing angle control module (panel) is additionally disposed on a conventionally operated display module (panel). The wide viewing angle mode to and the narrow viewing angle mode are switched by applying a voltage to the viewing angle control module. In this method, there is no interference or damage to the originally displayed image under the wide viewing angle mode, so that the quality of the original image can be kept. While in the narrow viewing angle mode, the brightness for the side view can be significantly inhibited, such that the viewers viewing from the side cannot easily judge and read the displayed message. However, due to the constitution of two modules, the overall weight and thickness are increased by one fold, and relatively increase the manufacturing costs.

In view of the above, conventional anti-peep techniques of display devices achieve anti-peep effects, but simultaneously sacrifice some of original characteristics of display devices, such as display quality, optical property, thickness and weight. Therefore, the conventional anti-peep technique still has space for improvement.

SUMMARY

One object of the present disclosure is to provide a liquid crystal display panel, so as to realize an effective anti-peep effect under a premise of not increasing the cost and the manufacture complexity.

In one aspect of the present disclosure, a display device with an adjustable viewing angle is provided. The display device with an adjustable viewing angle includes a panel, at least one first display area, at least one second display area, a first electrode, a second electrode, a third electrode, a fourth electrode and a fifth electrode. The panel includes a first substrate, a second substrate corresponding to the first substrate, and a display medium layer. The display medium layer is intervened between the first substrate and the second substrate. The first display area and the second display area are defined on the panel. Each of he first display area and the second display area at least include a first sub-pixel and a second sub-pixel adjacent to the first sub-pixel. The first electrode is spaced apart from the second electrode. The first electrode and the second electrode are arranged in the first sub-pixel on the first substrate. The third electrode is spaced apart from the fourth electrode. The third electrode and the fourth electrode are arranged in the second sub-pixel on the first substrate. The fifth electrode is arranged in the first sub-pixel on the second substrate and in the second sub-pixel on the second substrate. When the display device is operated in a wide viewing angle mode, the first and second sub-pixels each have an on-axis brightness at a predetermined gray level. When the display device is operated in a narrow viewing angle mode, the first sub-pixel has an on-axis brightness at a first gray level and the second sub-pixel has an on-axis brightness at a second gray level. The first on-axis brightness at the first gray level is substantially less than the on-axis brightness at the predetermined gray level of the first sub-pixel.

According to an embodiment of the present disclosure, a sum of the on-axis brightness at the first gray level of the first sub-pixel and the on-axis brightness at the second gray level of the second sub-pixel in any one of the first display area and the second display area under the narrow viewing angle mode is substantially equal to a sum of the on-axis brightness at the predetermined gray level of the first sub-pixel and the on-axis brightness at the predetermined gray level of the second sub-pixel in a corresponding one of the to first display area and the second display area under the wide viewing angle mode.

According to another embodiment of the present disclosure, in the narrow viewing angle mode, the on-axis brightness at the first gray level of the first display area and the on-axis brightness at the first gray level of the second display area are of an on-axis brightness at a gray level of 0.

According to yet another embodiment of the present disclosure, the on-axis brightness at the second gray level of the second sub-pixel in any one of the first display area and the second display area in the narrow viewing angle mode is substantially greater than or substantially equal to the on-axis brightness at the predetermined gray level of the second sub-pixel in any one of the first display area and the second display area in the wide viewing angle mode.

According to still yet another embodiment of the present disclosure, in the narrow viewing angle mode, the ratio of the on-axis brightness at the first gray level, that corresponds to an on-axis brightness at any one of the predetermined gray level of greater than a first critical value, to the on-axis brightness at the second gray level is substantially ranged from 0.3 to 1, and wherein the first critical value is an integer substantially ranged from 192 to 232.

According to an embodiment of the present disclosure, in the narrow viewing angle mode, the ratio of the on-axis brightness at the first gray level, that corresponds to an on-axis brightness at any one of the predetermined gray level between the first critical value and a second critical value, to the on-axis brightness at the second gray is substantially ranged from 0 to 0.3, and wherein the second critical value is an integer substantially ranged between 10 and 50.

According to another embodiment of the present disclosure, in the narrow viewing angle mode, the ratio of the on-axis brightness at the first gray level, that corresponds to an on-axis brightness at any one of the predetermined gray level between the second critical value and 0, to the on-axis brightness at the second gray level is substantially ranged from 0.1 to 1, alternatively the ratio of the on-axis brightness at the second gray level, that corresponds to an on-axis brightness at any one of the predetermined gray level between the second critical value and 0, to the on-axis brightness at the first gray level is substantially ranged from 0.1 to 1.

According to yet another embodiment of the present disclosure, in the narrow viewing angle mode, the ratio of the on-axis brightness at the first gray level, that corresponds to an on-axis brightness at any one of the predetermined gray level less than a first critical value, to the on-axis brightness at the second gray level is substantially equal to 0, and wherein the ratio of the on-axis brightness at the first gray level, that corresponds to an on-axis brightness at any one of the predetermined gray level greater than the first critical value, to the on-axis brightness at the second gray level is substantially greater than 0 but less than or substantially equal to 1, and wherein the first critical value is an integer substantially ranged from 160 to 220.

According to still yet another embodiment of the present disclosure, in the narrow viewing angle mode, the on-axis brightness at the first gray level, that corresponds to an on-axis brightness at any one of the predetermined gray level less than a first critical value, is a brightness at a gray level of 0, and the on-axis brightness at the second gray level, that corresponds to an on-axis brightness at any of the predetermined gray level greater than the first critical value, is an on-axis brightness at a gray level of 255, wherein the first critical value is an integer substantially ranged between 160 and 220.

A display device with an adjustable viewing angle includes a pixel array. This pixel array at least includes a first pixel group and a second pixel group. Each of the first and second pixel groups at least includes a first sub-pixel and a second sub-pixel. The first sub-pixel includes a plurality of first electrodes which are substantially parallel with each other. The second sub-pixel includes a plurality of second electrodes which are substantially parallel with each other. However, the second electrodes are not parallel to these first electrodes which are substantially parallel with each other. When the display device is operated in a wide viewing angle mode, each of the first and second sub-pixels has an on-axis brightness at a predetermined gray level between 0 and 255. The on-axis brightness at the predetermined gray level between 0 and 255 has a first critical range and a second critical range. As such, the on-axis brightness at the predetermined gray level between 0 and 255 is divided into a first range, a second range and a third range. The first critical range is between the first range and the second range, and the second critical range is between the second range and the third range. The first critical range is substantially ranged from 192 232 and the second critical range is substantially ranged from 10 to 50. When the display device is operated in a narrow viewing angle mode, one of the following may be selected:

a) when the on-axis brightness at the gray levels of the first sub-pixel and the second sub-pixel is located in the first range, the ratio of the on-axis brightness at the gray level of the first sub-pixel to the on-axis brightness at the gray level of the second sub-pixel is substantially ranged from 0.3 to 1;

b) when the on-axis brightness at the gray levels of the first sub-pixel and the second sub-pixel is located in the second range, the ratio of the on-axis brightness at the gray level of the first sub-pixels to the on-axis brightness at the gray level of the second sub-pixels is substantially ranged from 0 to 0.3; or c) when the on-axis brightness at the gray levels of the first sub-pixel and the second sub-pixel is located in the third range, the ratio of the on-axis brightness at the gray level of the first sub-pixels to the on-axis brightness at the gray level of the second sub-pixels is substantially ranged from 0.1 to 1.

According to an embodiment of the present disclosure, the first range is substantially ranged from 212 to 255, the second range is substantially ranged from 31 to 211, and the third range is substantially ranged from 0 to 30.

According to another embodiment of the present disclosure, a sum of the on-axis brightness at the gray levels of the first sub-pixel and the second sub-pixel in any one of the first pixel group and the second pixel group under the narrow viewing angle mode is substantially equal to a sum of the on-axis brightness at the gray levels of the first sub-pixel and the second sub-pixel in any one of the first pixel group and the second pixel group under the wide viewing angle mode.

According to yet another embodiment of the present disclosure, the on-axis brightness at the gray level of the first sub-pixel in any one of the first pixel group and the second pixel group under the narrow viewing angle mode is substantially less than the on-axis brightness at the gray level of the first sub-pixel in any one of the first pixel group and the second pixel group under the wide viewing angle mode.

According to still yet another embodiment of the present disclosure, the display device further includes a first substrate, a second substrate corresponding to the first substrate, and a display medium layer. The display medium layer is intervened between the first substrate and the second substrate so as to form a panel, such that the first pixel group and the second pixel group in the pixel array are defined on the panel. The first sub-pixel is further provided with a third electrode spaced apart from the first electrodes. The third electrode and the first electrodes are arranged in the first sub-pixel on the first substrate. The second sub-pixel is further provided with a fourth electrode spaced apart from the second electrodes. The fourth electrode and the second electrodes are arranged in the second sub-pixel on the first substrate. The display device further includes a fifth electrode. The fifth electrode is arranged in the first sub-pixel on the second substrate and in the second sub-pixel on the second substrate.

According to an embodiment of the present disclosure, each of the electrodes of the first sub-pixel and the second sub-pixel in any one of the first pixel group and the second pixel group has an extending direction, and the extending directions substantially form a V shape.

Another aspect of the present disclosure provides a method for driving a display device with an adjustable viewing angle. This method includes providing a display device including a pixel array that at least has a first pixel group and a second pixel group. Each of the first and second pixel groups at least includes a first sub-pixel and a second sub-pixel, in which the first sub-pixel includes a plurality of first electrodes which are substantially parallel with each other, and the second sub-pixel includes a plurality of second electrodes which are substantially parallel with each other. The second electrodes are not parallel to the first electrodes which are substantially parallel with each other. In a wide viewing angle mode, each of the first and second sub-pixels has an on-axis brightness at a predetermined gray level between 0 and 255. The on-axis brightness at the predetermined gray level between 0 and 255 has a first critical range and a second critical range such that the on-axis brightness at the predetermined gray level between 0 and 255 is divided into a first range, a second range and a third range. The first critical range is between the first range and the second range, and the second critical range is between the second range and the third range, in which the first critical range is substantially ranged from 192 to 232 and the second critical range is substantially ranged from 10 to 50. In a narrow viewing angle mode, one of the following may be selected:

a) when the on-axis brightness at the gray levels of the first sub-pixel and the second sub-pixel is located in the first range, the ratio of the on-axis brightness at the gray level of the first sub-pixel to the on-axis brightness at the gray level of the second sub-pixel is substantially ranged from 0.3 to 1;

b) when the on-axis brightness at the gray levels of the first sub-pixel and the second sub-pixel is located in the second range, the ratio of the on-axis brightness at the gray level of the first sub-pixels to the on-axis brightness at the gray level of the second sub-pixels is substantially ranged from 0 to 0.3; and c) when the on-axis brightness at the gray levels of the first sub-pixel and the second sub-pixel is located in the third range, the ratio of the on-axis brightness at the gray level of the first sub-pixels to the on-axis brightness at the gray level of the second sub-pixels is substantially equal to 0.

According to an embodiment of the present disclosure, the first range is substantially ranged from 212 to 255, the second range is substantially ranged from 31 to 211, and the third range is substantially ranged from 0 to 30.

According to another embodiment of the present disclosure, a sum of the on-axis brightness at the gray levels of the first sub-pixels and the second sub-pixel in any one of the first pixel group and the second pixel group under the narrow viewing angle mode is substantially equal to a sum of the on-axis brightness at the gray levels of the first sub-pixel and the second sub-pixel in any one of the first pixel group and the second pixel group under the wide viewing angle mode.

According to yet another embodiment of the present disclosure, the on-axis brightness at the gray level of the first sub-pixel in any one of the first pixel group and the second pixel group under the narrow viewing angle mode is substantially less than the on-axis brightness at the gray level of the first sub-pixel in any one of the first pixel group and the second pixel group under the wide viewing angle mode.

According to still yet another embodiment of the present disclosure, the display device further includes a first substrate, a second substrate corresponding to the first substrate, and a display medium layer. The display medium layer is intervened between the first substrate and the second substrate so as to form a panel, such that the first pixel group and the second pixel group in the pixel array are defined on the panel. The first sub-pixel is further provided with a third electrode spaced apart from the first electrodes. The third electrode and the first electrodes are arranged in the first sub-pixel on the first substrate. The second sub-pixel is further provided with a fourth electrode spaced apart from the second electrodes. The fourth electrode and the second electrodes are arranged in the second sub-pixel on the first substrate. The display device further includes a fifth electrode. The fifth electrode is arranged in the first sub-pixel on the second substrate and in the second sub-pixel on the second substrate.

According to an embodiment of the present disclosure, each of the electrodes of the first sub-pixel and the second sub-pixel in any one of the first pixel group and the second pixel group has an extending direction, and the extending directions substantially form a V shape.

A method for driving a display device with an adjustable viewing angle includes providing a display device including a pixel array which at least includes a first pixel group and a second pixel group. Each of the first and second pixel groups at least includes a first sub-pixel and a second sub-pixel. Each of the first sub-pixels includes a plurality of first electrodes which are substantially parallel with each other. Each of the second sub-pixels includes a plurality of second electrodes which are substantially parallel with each other. The second electrodes are not parallel to the first electrodes which are substantially parallel with each other. In a wide viewing angle mode, each of the first and the second sub-pixels has an on-axis brightness at a predetermined gray level between 0 and 255. In a narrow viewing angle mode, when an on-axis brightness of each of the first and second sub-pixels is less than an on-axis brightness corresponding to a first critical gray level, the on-axis brightness of each the first sub-pixel is an on-axis brightness at a gray level of 0, in which the first critical gray level is an integer between about 160 and about 220. When an on-axis brightness of each of the first and second sub-pixels is greater than the on-axis brightness corresponding to the first critical gray level, the on-axis brightness of each the second sub-pixel is an on-axis brightness at a gray level of 255.

BRIEF DESCRIPTION OF THE DRAWINGS

In order to make the following as well as other aspects, features, advantages, and embodiments of the present disclosure more apparent, the accompanying drawings are described as follows.

DETAILED DESCRIPTION

Figure 1A:
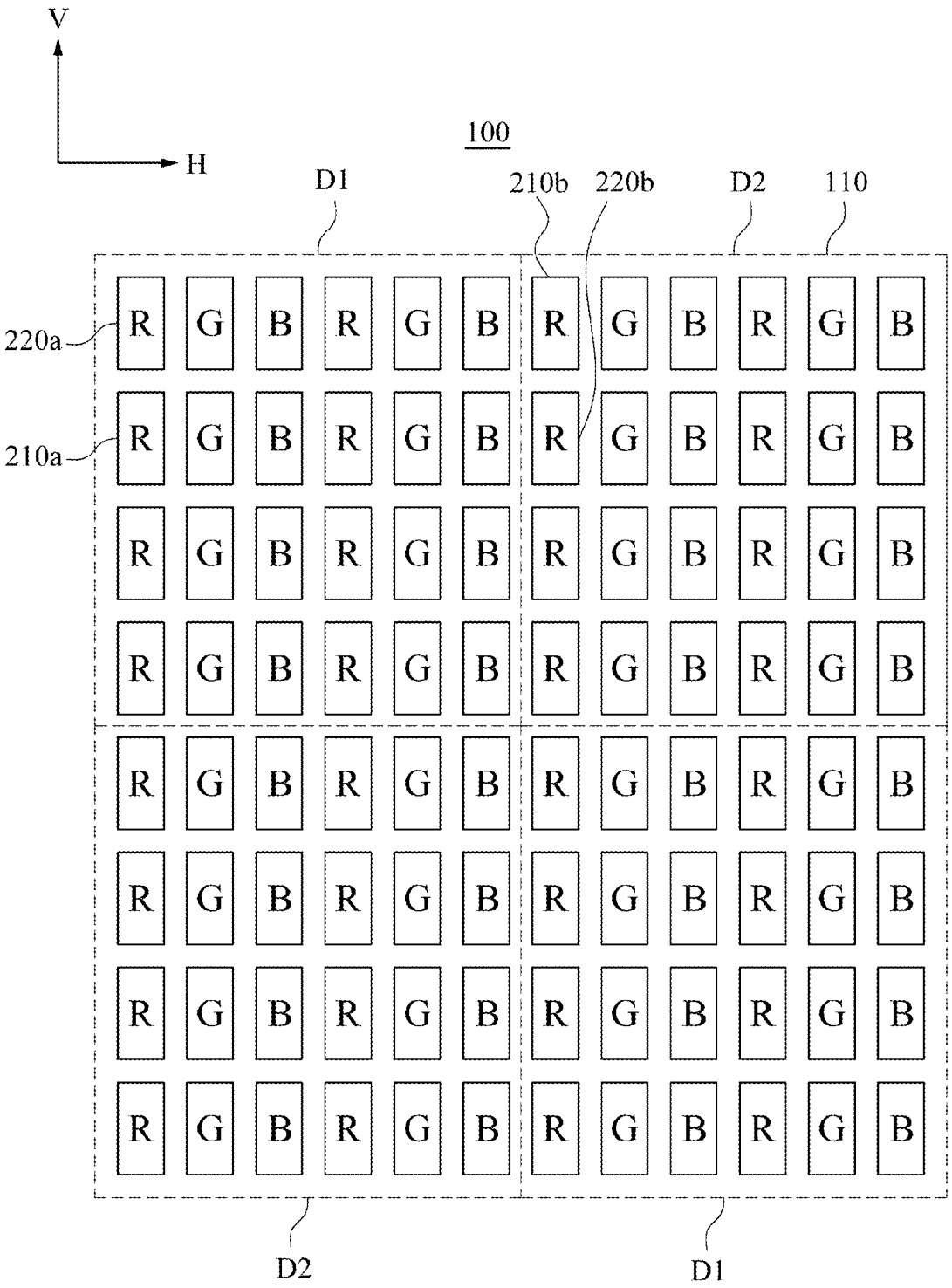
FIG. 1A is a top view schematically illustrating a display device with an adjustable viewing angle operated in a wide viewing angle mode according to a first embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

First Embodiment

FIG. 1A is a top view schematically illustrating a display device 100 with an adjustable viewing angle operated in a wide viewing angle mode according to a first embodiment of the present disclosure. The display device 100 with the adjustable viewing angle includes a panel 110. At least one first display area D1 and at least one second display area D2 are defined on the panel 110. The at least one first display area D1 includes at least one first sub-pixel 210*a* and at least one second sub-pixel 220*a*. The at least one second sub-pixel 220*a* is adjacent to the at least one first sub-pixel 210*a*. The at least one second display area D2 also includes at least one first sub-pixel 210*b* and at least one second sub-pixel 220*b*. The at least one second sub-pixel 220*b* of the at least one second display area D2 are adjacent to the at least one first sub-pixel 210*b* of the at least one second display area D2. In one specific example, a plurality of the first display areas D1 and a plurality of the second display areas D2 are defined on the panel 110. Moreover, each of the first display areas D1 includes a plurality of the first sub-pixels 210*a* and a plurality of the second sub-pixels 220*a*. Each of the second display areas D2 also includes a plurality of the first sub-pixels 210*b* and a plurality of the second sub-pixels 220*b*.

Figure 1B:
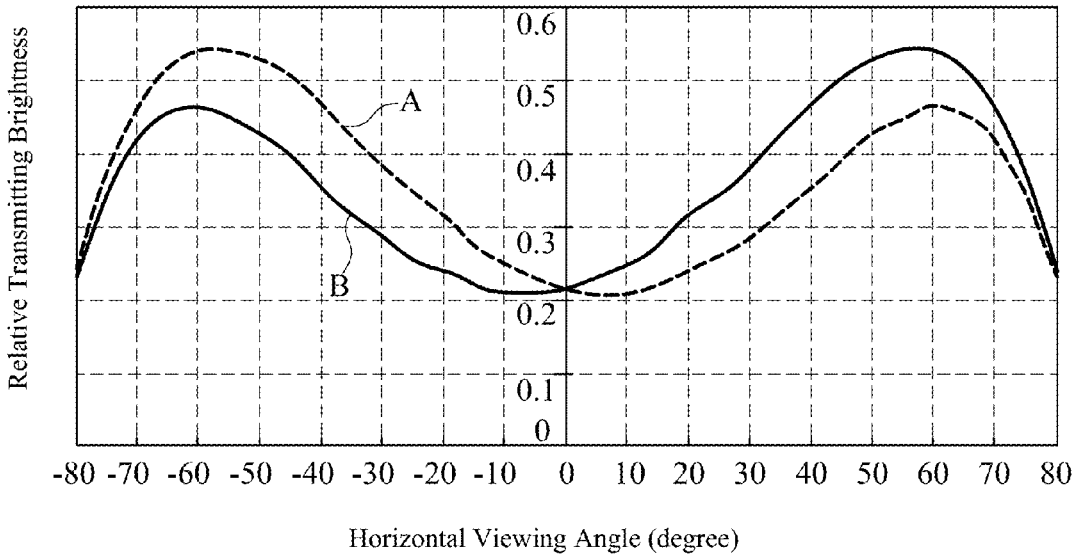
FIGS. 1B and 1C schematically illustrate diagrams for relationships between the relative transmitting brightness of first sub-pixels and second sub-pixels of the display device with an adjustable viewing angle according to the first embodiment of the present disclosure and a horizontal viewing angle.
Figure 1C:
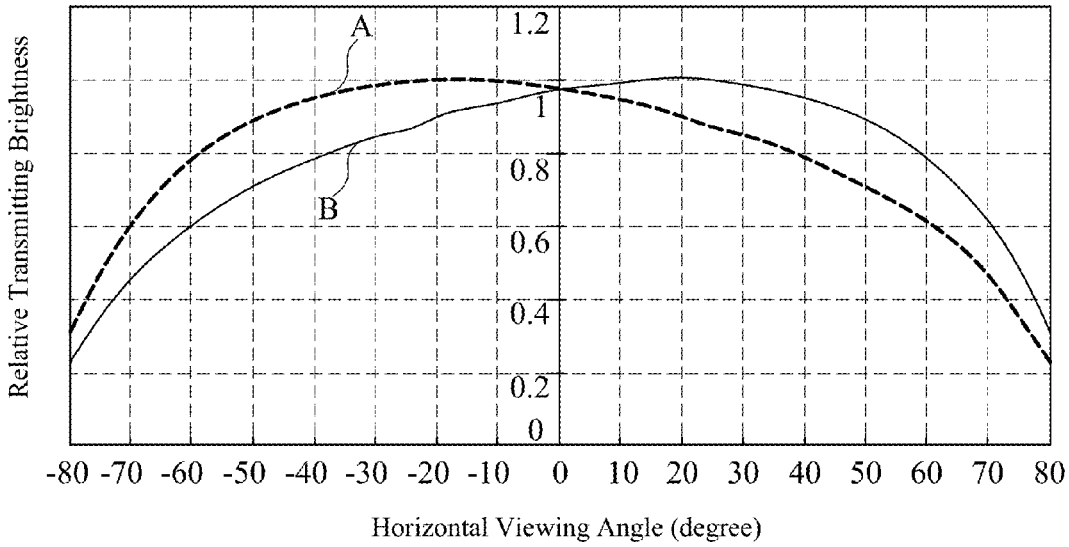
Figure 10:
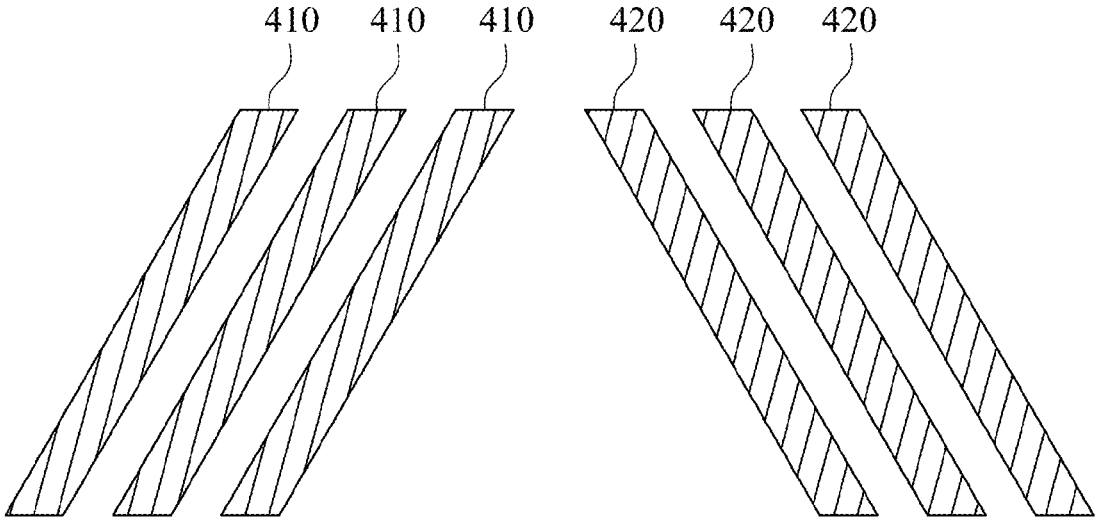
FIG. 10 is a top view schematically illustrating the first electrodes and the second electrodes according to the second embodiment of the present disclosure.

FIGS. 1B and 1C schematically illustrate diagrams for relationships between a horizontal viewing angle and the relative transmitting brightness of both the first sub-pixels 210*a* and the second sub-pixels 220*a* of the display device 100 shown in FIG. 1A. FIG. 1B illustrates a result when the pixel electrode voltage is about 3 V, while FIG. 10 illustrates a result when the pixel electrode voltage is about 5 V. As shown in FIGS. 1B and 1C, in this embodiment, the curve A represents the brightness of the first sub-pixels 210*a* at various viewing angles in the horizontal direction. The brightness herein refers to a normalized brightness, i.e., the relative transmitting brightness without a unit. The curve B represents the brightness of the second sub-pixels 220*a* at various viewing angles in the horizontal direction. The brightness refers to the normalized brightness as well, i.e., the relative transmitting brightness without the unit. In the on-axis or namely normal viewing direction, the first sub-pixels 210*a* and the second sub-pixels 220*a* have substantially the same brightness. However, when the display device 100 is viewed at other viewing angles in the horizontal direction, the luminous flux (light quantity) of the first sub-pixels 210*a* is substantially different from that of the second sub-pixels 220*a*. The normal view refers to that the viewing direction of the viewer forms a substantially right angle with the surface of the display device 100 (in a direction normal to the panel). Other viewing angles refer to that the viewing direction of the viewer forms an angle less than about 80 degrees with the surface of the display device. It should be noted that when the brightness of the first sub-pixels 210*a* and the brightness of the second sub-pixels 220*a* are at the same viewing angle, it is required to use the viewing angle which is not an absolute value as a judgment basis. The same viewing angle which is not the absolute value refers to that the viewing angle within which the brightness of the first sub-pixels 210*a* and the second sub-pixels 220*a* being both positive values (+) or both negative values (−) is used as the basis. Such viewing angle is not the viewing angle within which the brightness of the first sub-pixels 210*a* is a positive value (+) while the brightness of the second sub-pixels 220*a* is a negative value (−). Such viewing angle is also not the viewing angle within which the brightness of the first sub-pixels 210*a* is a negative value (−) while the brightness of the second sub-pixels 220*a* is a positive value (+). The reason is that left and right eyes of a person cannot view at the viewing angles in the existence of both the positive and negative values. At the moment, if the first sub-pixels 210*a* and the second sub-pixels 220*a* have different brightness at the same viewing angle, the information (figures or characters/words) of the display panel cannot be known by the viewers. In such a way, the effect of keeping the information secret is achieved.

Figure 2A:
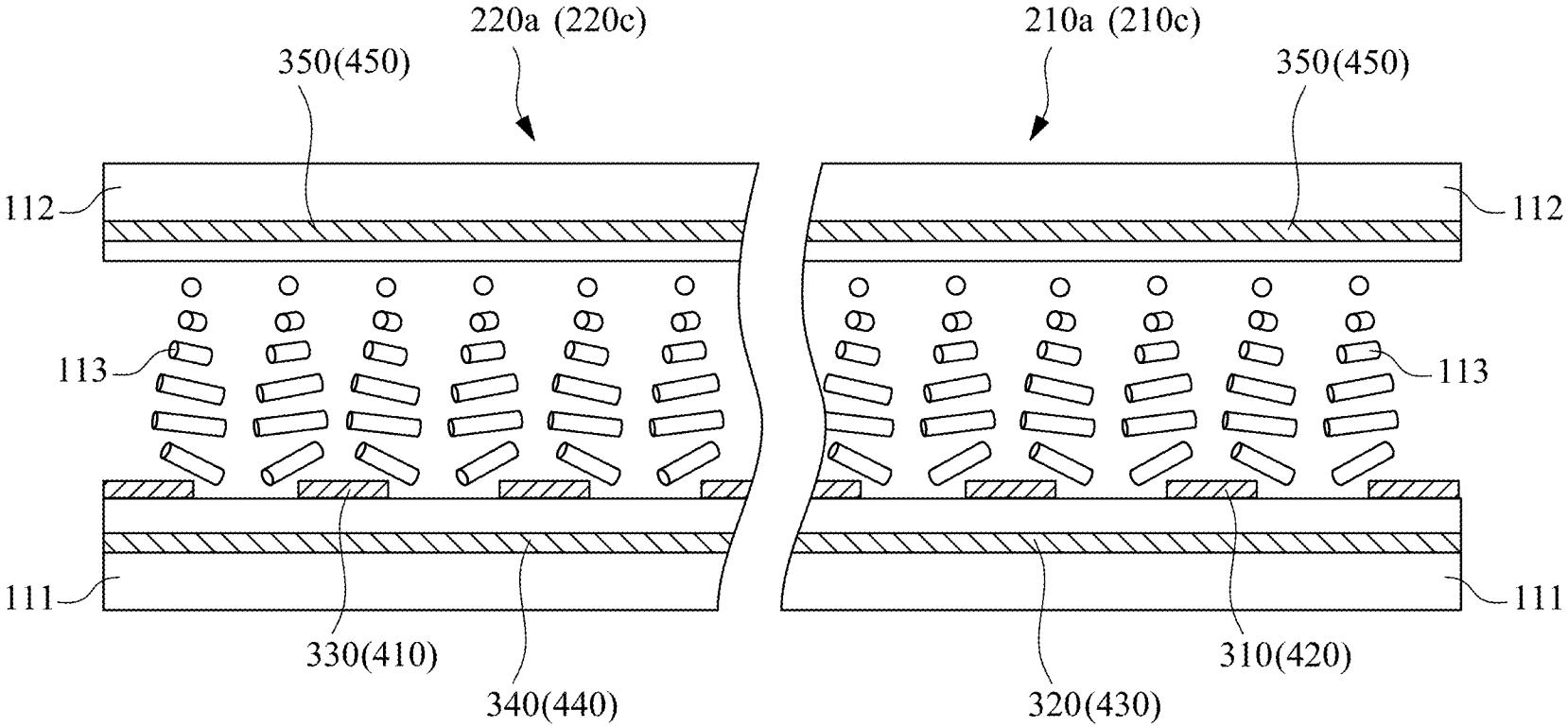
FIG. 2A is a cross-sectional view schematically illustrating the panel 110 according to the first embodiment of the present disclosure.

FIG. 2A is a cross-sectional view schematically illustrating the panel 110 according to the first embodiment of the present disclosure. The panel 110 includes a first substrate 111, a second substrate 112 and a display medium layer 113. The first substrate 111 corresponds to the second substrate 112. Moreover, the display medium layer 113 is intervened between the first substrate 111 and the second substrate 112. The display medium layer 113 is a non-self-luminous display medium layer 130 and may include a liquid crystal layer, an electrophoresis layer, an electro-wetting layer or other suitable materials. The display medium layer 113 preferably includes the liquid crystal layer. In one specific example, the sub-pixels in the same color are arranged along the V direction. In the H direction, the red sub-pixels R, the green sub-pixels G and the blue sub-pixels B are repeatedly arranged. In this embodiment, the sub-pixels in three colors are taken as example. In other examples, the sub-pixels in two colors, the sub-pixels in four colors or the sub-pixels in the colors of other numbers are also available. Besides the R, G, B sub-pixels, the color also can be selected from any color appeared on the chromaticity coordinates, for example white (or named a transparent color), yellow, pink, purple, orange-yellow and the like.

The display device 100 with the adjustable viewing angle also includes a first electrode 310, a second electrode 320, a third electrode 330, a fourth electrode 340 and a fifth electrode 350, as shown in FIG. 2A. The first electrode 310 and the second electrode 320 are arranged (or namely disposed) in the first sub-pixels 210*a* on the first substrate 111. The first electrode 310 and the second electrode 320 are spaced apart from each other. That is, the first electrode 310 and the second electrode 320 are not contacted with each other. The third electrode 330 and the fourth electrode 340 are arranged (or namely disposed) in the second sub-pixels 220*a* on the first substrate 111. The third electrode 330 and the fourth electrode 340 are spaced apart from each other. That is, the third electrode 330 and the fourth electrode 340 are not contacted with each other. Each of the first electrode 310 and the third electrode 330 may for example be a comb electrode, and acted as a pixel electrode of the sub-pixel (that is, each of the electrodes is connected to a drain electrode of a transistor of each of the sub-pixels.) In this case, the first electrode 310 and the third electrode 330 are not contacted with each other. However, each of the second electrode 320 and the fourth electrode 340 may for example be a common electrode. In other words, the pixel electrodes (310, 330) are located above the common electrodes (320, 340). Alternatively, the first electrode 310 and the third electrode 330 may for example be a comb electrode and acted as the common electrode, while each of the second electrode 320 and the fourth electrode 340 is acted as the pixel electrode of the sub-pixel (that is, each of the aforesaid electrodes is connected to the drain electrode of the transistor of each of the sub-pixels.) In this case, the second electrode 320 and the fourth electrode 340 are not contacted with each other. In other words, the pixel electrodes (320, 340) are located below the common electrodes (310, 330). The fifth electrode 350 is arranged (or namely disposed) in the first sub-pixels 210*a* of the second substrate 112 and in the second sub-pixels 220*a* of the second substrate 112. The fifth electrode 350 may for example be the common electrode. The fifth electrode 350 is not contacted with each of the electrodes acted as the pixel electrodes. For example, (1) when the first electrode 310 and the third electrode 330 are used as the pixel electrodes of the sub-pixels, and the second electrode 320 and the fourth electrode 340 may for example be the common electrodes, the fifth electrode 350 is not physically contacted with the first electrode 310 and the third electrode 330. Alternatively, (2) when the second electrode 320 and the fourth electrode 340 are used as the pixel electrodes of the sub-pixels, and the first electrode 310 and the third electrode 330 may for example be the common electrodes, the fifth electrode 350 is not physically contacted with the second electrode 320 and the fourth electrode 340. Furthermore, the fifth electrodes 350 in the sub-pixels 210*a* and 220*a* are optionally contacted with each other or not. That is, the fifth electrodes 350 in the sub-pixels 210*a* and 220*a* optionally receive either substantially the same voltage or different voltages.

Figure 2B:
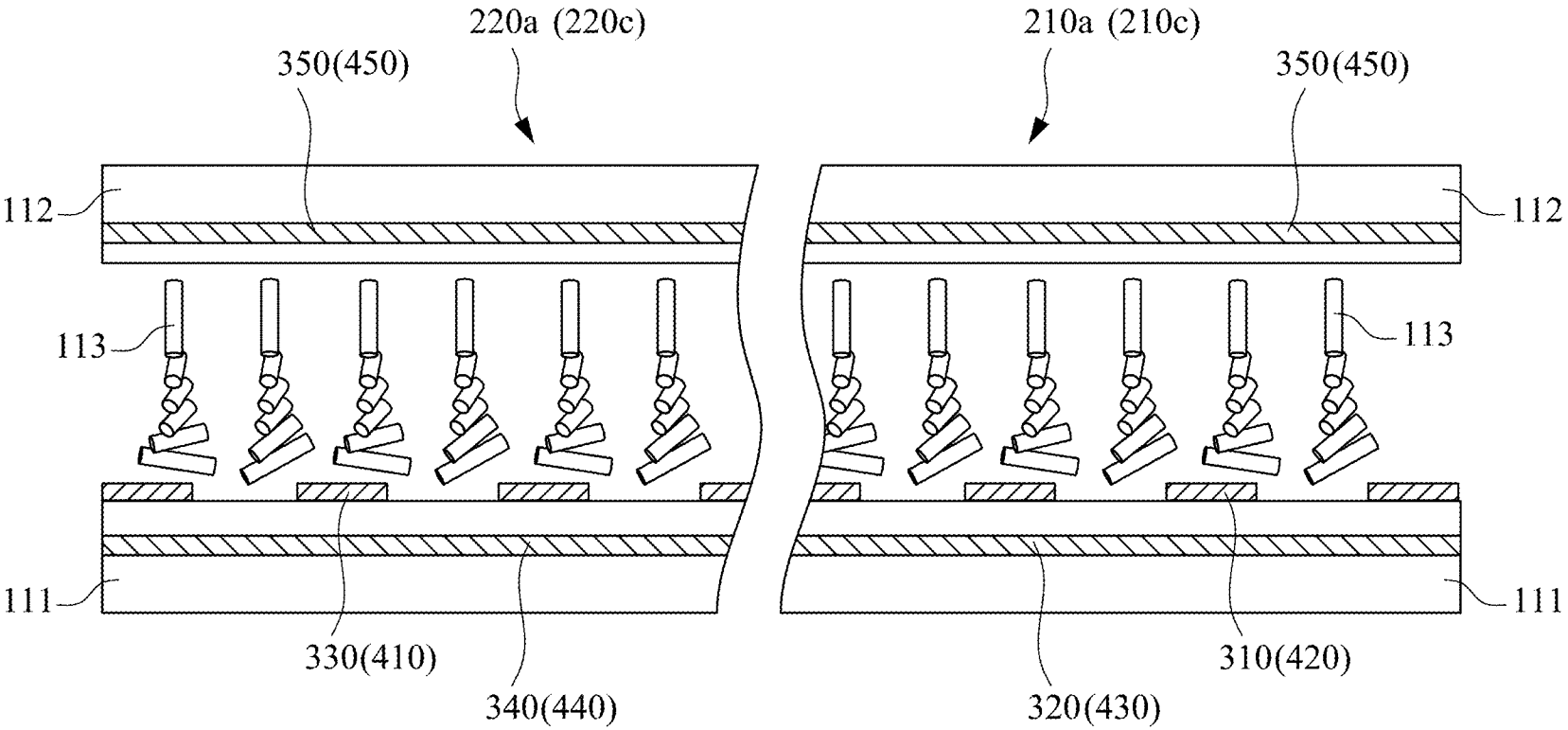
FIG. 2B illustrates a schematic view of liquid crystal orientation in the display device with an adjustable viewing angle operated in a narrow viewing angle mode according to the first embodiment of the present disclosure.

The display device 100 has a function of availably adjusting the viewing angle. In this embodiment in which the display medium layer 113 is liquid crystal molecules (the display medium layer 113 of the present disclosure is not limited to the liquid crystal molecules), when the display device 100 is operated in the wide viewing angle mode, the orientation of the liquid crystal molecules is schematically shown in FIG. 2A. When the display device 100 is operated in the narrow viewing angle mode, the orientation of the liquid crystal molecules is schematically shown in FIG. 2B. Therefore, the orientation and the torsion situation of the liquid crystal molecules 113 from the first substrate 111 to the second substrate 112 in the wide viewing angle mode shown in FIG. 2A are completely different from that in the narrow viewing angle mode shown in FIG. 2B.

Figure 3B:
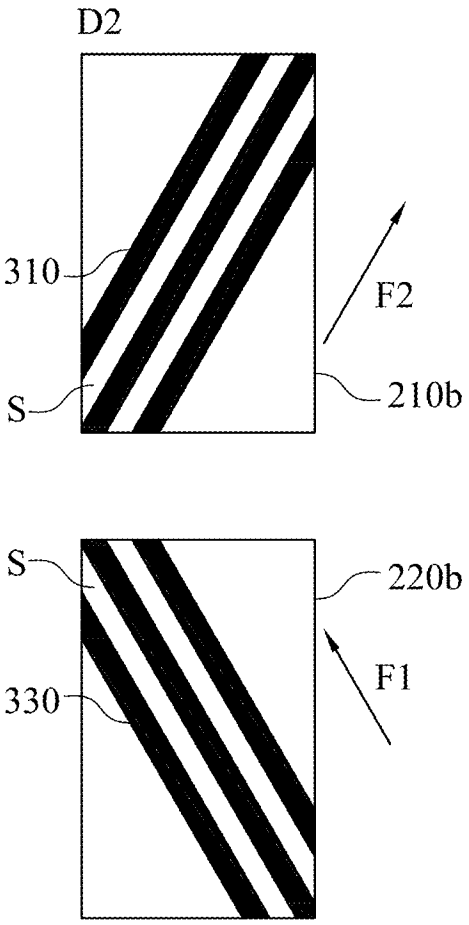
FIG. 3B is a top view schematically illustrating the first electrodes of the first sub-pixel and the third electrodes of the second sub-pixel in the second display area according to the first embodiment of the present disclosure.
Figure 3A:
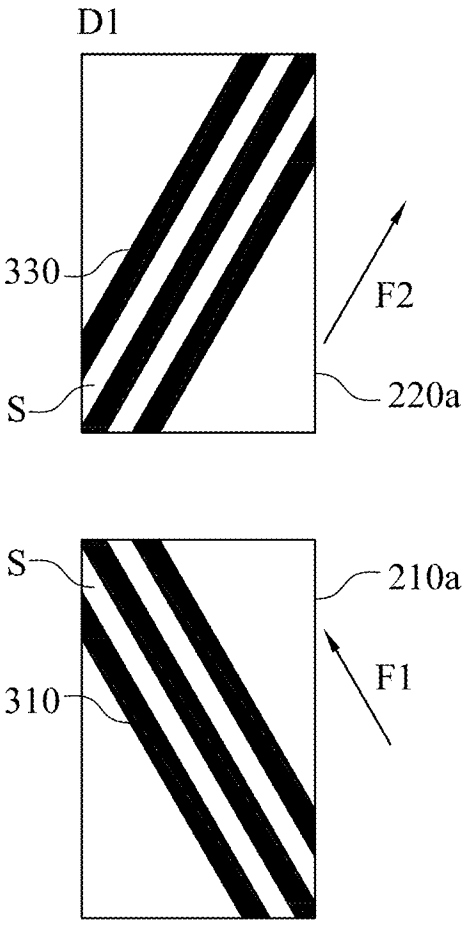
FIG. 3A is a top view schematically illustrating the first electrodes of the first sub-pixel and the third electrodes of the second sub-pixel in the first display to area according to the first embodiment of the present disclosure.
Figure 4:
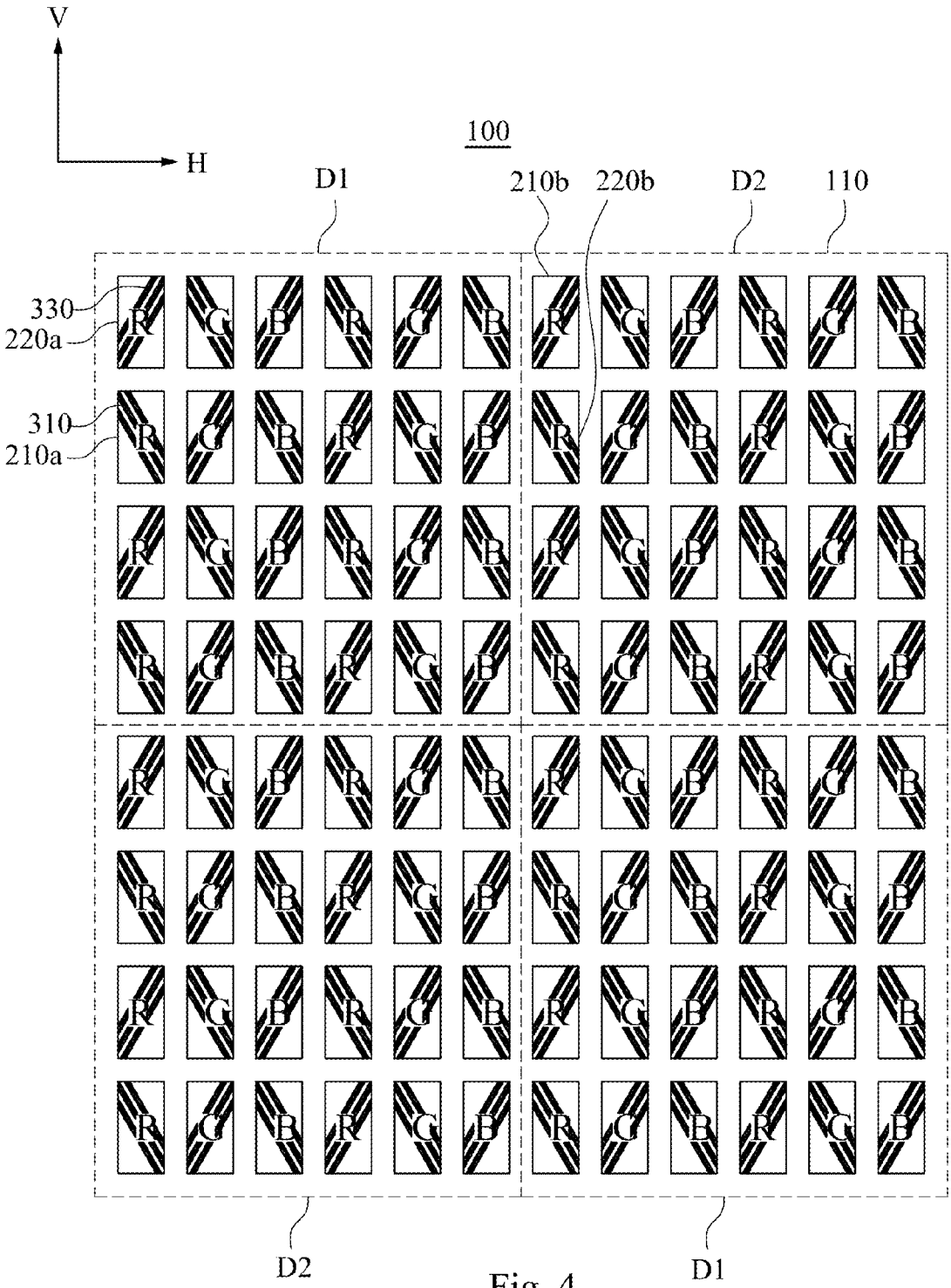
FIG. 4 is a top view schematically illustrating the configuration of these first electrodes and these third electrodes on the panel according to the first embodiment of the present disclosure.

FIG. 3A is a top view schematically illustrating the first electrodes 310 of the first sub-pixel 210*a* and the third electrodes 330 of the second sub-pixel 220*a* in the first display area D1 according to the first embodiment of the present disclosure. FIG. 3B is a top view schematically illustrating the first electrodes 310 of the first sub-pixel 210*b* and the third electrodes 330 of the second sub-pixel 220*b* in the second display area D2 according to the first embodiment of the present disclosure. FIG. 4 is a top view schematically illustrating the configuration of these first electrodes 310 and these third electrodes 330 on the panel. Each of the first electrodes 310 and each of the third electrodes 330 respectively have at least one slit S, so that each of the first electrodes 310 and each of the third electrodes 330 can be divided into a plurality of first sub-electrodes and a plurality of third sub-electrodes. Therefore, the sub-electrodes in each of the first sub-pixels are substantially parallel with each other. Moreover, the sub-electrodes in each of the second sub-pixels are substantially parallel with each other as well. However, the sub-electrodes in each of the first sub-pixels are not parallel with those in each of the second sub-pixels, as shown in FIGS. 3A and 3B. In addition, as shown in FIGS. 3A and 3B, the first electrodes 310 of the first sub-pixels 210*a* in the first display area D1 extend towards a first direction F1 (or referred to as the extending direction of the slit). The third electrodes 330 of the second sub-pixels 220*a* in the first display area D1 extend toward a second direction F2 (or referred to as the extending direction of the slit). The first electrodes 310 of the first sub-pixels 210*b* in the second display area D2 extend towards the second direction F2 (or referred to as the extending direction of the slit). The third electrodes 330 of the second sub-pixels 220*b* in the second display area D2 extend toward the first direction F1 (or referred to as the extending direction of the slit). The extending directions of the first electrode 310 and third electrode 330 of two adjacent first sub-pixel 210*a*/210*b* and second sub-pixel 220*a*/220*b* in each of the display areas D1 and D2 substantially form a V shape or V-like shape. For example, the extending directions of the first electrodes 310 and third electrodes 330 of two adjacent first sub-pixel 210*a* and second sub-pixel 220*a* in the same column at the left top corner shown in FIG. 4 form a shape similar to "<" or ">". However, the extending directions of the first electrodes 310 of two adjacent first sub-pixels 210 in the same row and the extending directions of the third electrodes 310 of two adjacent second sub-pixels 220 in the same row from a shape similar to "∨" or "∧". Furthermore, the extending directions of the first electrodes or the third electrodes of the first or second sub-pixel at the boundary of two adjacent display areas (D1, D2) form at least one of the aforesaid four shapes. In the above descriptions, the first and second sub-pixels arranged from top to bottom are taken for example. For the arrangement from left to right, the shapes formed by the first and/or third electrodes are changed. For example, the shapes similar to "<" or ">" are changed into those similar to "∨" or "∧". Alternatively, the shapes similar to "∨" or "∧" are changed into those similar to "<" or ">".

Specifically, the extending directions of these first electrodes 310 of the first sub-pixel 210*a* and these second electrodes 320 of the second sub-pixel 220*a* in the first display area D1 form at least one of the shapes "∨", "∧", "<" and ">", as shown in FIG. 3A or FIG. 4. The extending directions of these first electrodes 310 of the first sub-pixel 210*b* and these second electrodes 320 of the second sub-pixels 220*b* in the second display area D2 form at least one of the shapes "∨", "∧", "<" and ">", as shown in FIG. 3B or FIG. 4.

Figure 5A:
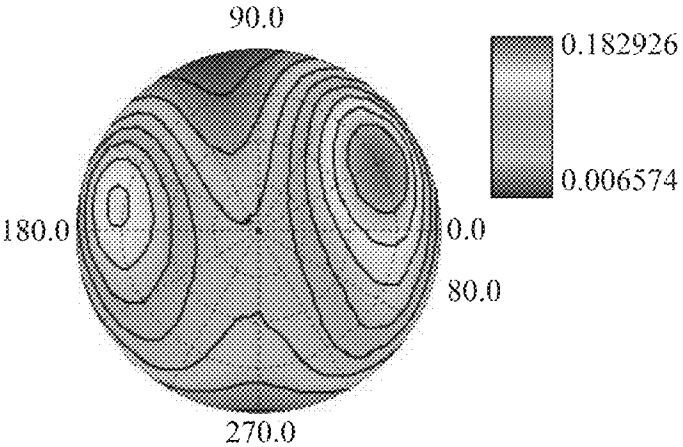
FIGS. 5A and 5B respectively illustrate iso-luminance diagrams of the second sub-pixel at various viewing angles when the pixel voltages are respectively 3 V and 5 V according to the first embodiment of the present disclosure.
Figure 5B:
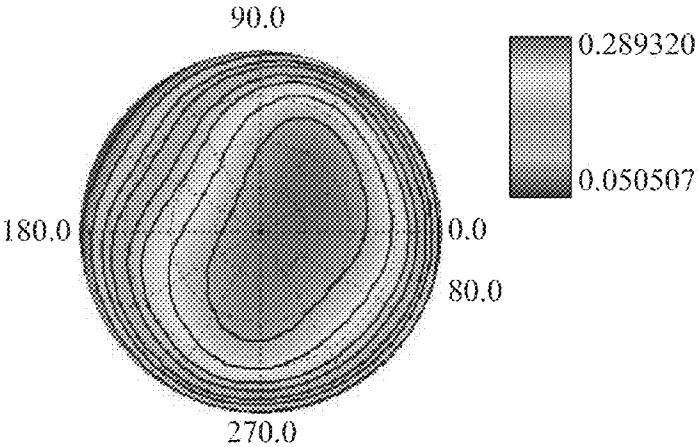
Figure 5C:
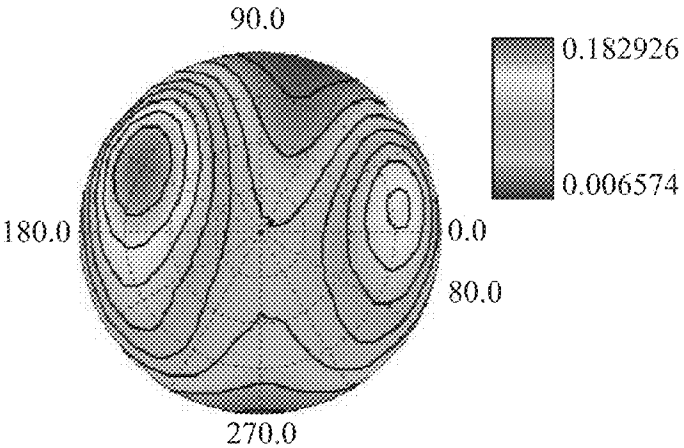
FIGS. 5C and 5D respectively illustrate iso-luminance diagrams of the first sub-pixels at various viewing angles when the pixel voltages are respectively 3 V and 5 V according to the first embodiment of the present disclosure.
Figure 5D:
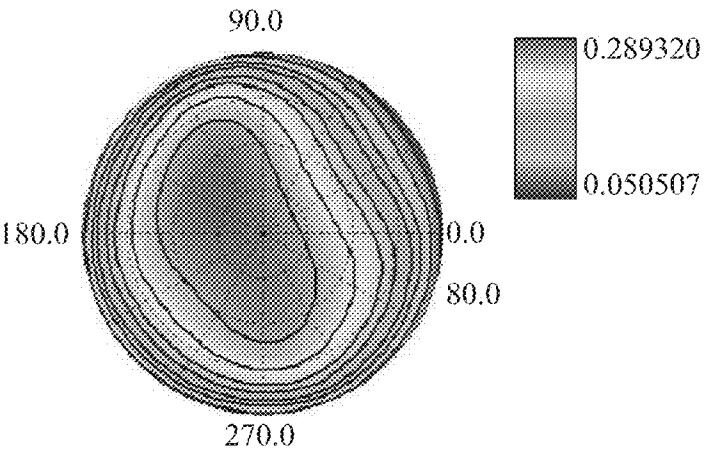

In this embodiment, the first electrodes 310 and the third electrodes 330 are used for providing the sub-pixels with the viewing angles in different directions. FIGS. 5A and 5B respectively illustrate iso-luminance diagrams of the second sub-pixels 220*a* at various viewing angles when the pixel voltages are respectively about 3 V and about 5 V. Since the third electrodes 330 of the second sub-pixels 220*a* extend towards the second direction F2, the maximum brightness appears in a specific direction in FIGS. 5A and 5B. FIGS. 5C and 5D respectively illustrate the iso-luminance diagrams of the first sub-pixels 210*a* at various viewing angles when the pixel voltages are respectively about 3 V and about 5 V. Since the first electrodes 310 of the first sub-pixels 210*a* extend towards the first direction F1, the maximum brightness appears in another specific direction in FIGS. 5C and 5D. In the FIGS. 5A to 5D, the numbers 0, 90, 180 and 270 in the iso-luminance diagrams represent azimuth angles (unit: degree) of the polar coordinates. The number 80 in each of the diagrams represents an inclined angle (zenith angle). The different-depth colors represent a normalized value (unit: no) respectively. That is, when the color is darker (for example, 0.182926 or 0.289320), the brightness is higher. When the color is lighter (for example, 0.006574 or 0.050507), the brightness is lower.

Figure 5E:
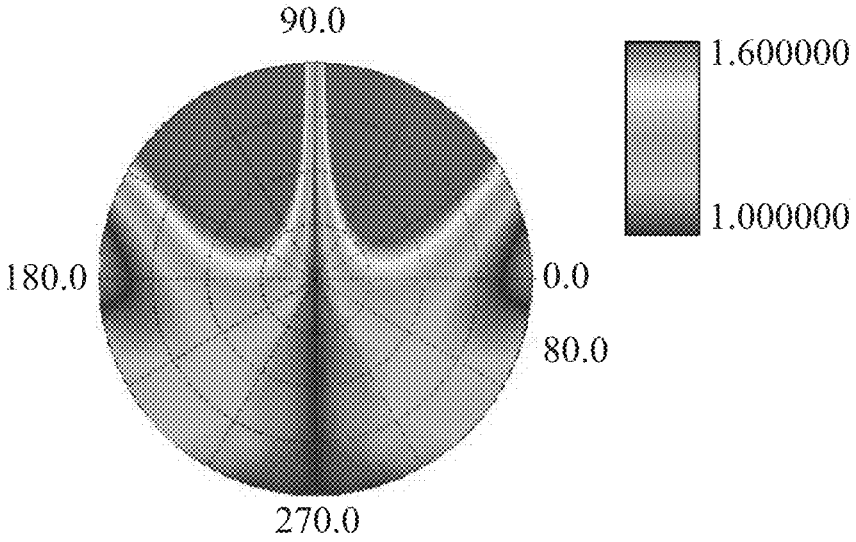
FIGS. 5E and 5F respectively illustrate diagrams of iso-bright-to-dark contrast of the second sub-pixels relative to the first sub-pixels when the pixel voltages are respectively 3 V and 5 V according to the first embodiment of the present disclosure.
Figure 5F:
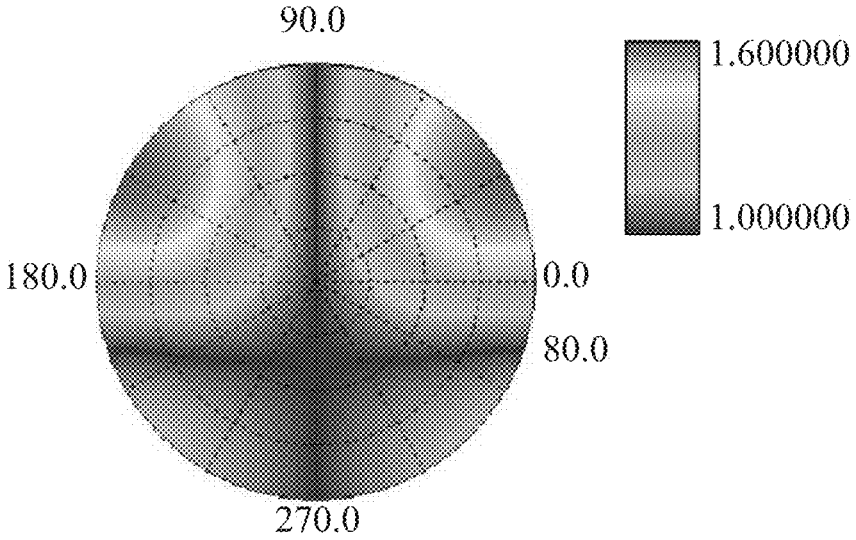

FIGS. 5E and 5F respectively illustrate diagrams of iso-bright-to-dark contrast of the second sub-pixels relative to the first sub-pixels when the pixel voltages are respectively about 3 V and about 5 V. FIGS. 5E and 5F can prove that the second sub-pixels and the first sub-pixels have quite high degree of bright-to-dark contrast within a quite wide viewing angle range. In the FIGS. 5E and 5F, the numbers 0, 90, 180 and 270 in the iso-contrast diagrams represent the azimuth angles (unit: degree) of the polar coordinates. The different shades of colors represent a contrast value of the normalized value (unit: no) under each of the polar coordinates in the first sub-pixels and the second sub-pixels. That is, when the color is darker (for example, 1.600000), the relative brightness difference between the first sub-pixels and the second sub-pixels is larger. When the color is lighter (for example, 1.000000), the relative brightness difference between the first sub-pixels and the second sub-pixels is smaller. Moreover, the aforesaid contrast value refers to that the brightness of the first sub-pixels at all of the azimuth angles of the polar coordinate is divided by the brightness of the second sub-pixels at the all of the azimuth angles of the polar coordinate. Alternatively, the contrast value refers to that the brightness of the second sub-pixels at all of the azimuth angles of the polar coordinate is divided by the first sub-pixels at all of the azimuth angles of the polar coordinate.

Returning to FIG. 1A, when the display device 100 is operated in the wide viewing angle mode, each of the first sub-pixel 210*a* and the second sub-pixel 220*a* displays an on-axis brightness, i.e., the brightness measured in direction normal to the panel, at a predetermined gray level. For the aforesaid predetermined gray level, the predetermined gray level of the first sub-pixels 210*a* and the predetermined gray level of the second sub-pixels 220*a* are determined according to the data of a display frame. When the display device 100 is operated in the narrow viewing angle mode, the first sub-pixels 210*a* are enabled to display a first on-axis brightness at a first gray level, and the second sub-pixels 220*a* are enabled to display a second on-axis brightness at a second gray level.

The brightness at the first gray level of the first sub-pixels 210*a* in the narrow viewing angle mode is substantially less than the on-axis brightness at the predetermined gray level of the first sub-pixels 210*a* in the wide viewing angle mode. More detailed descriptions will be given below.

Figure 6:
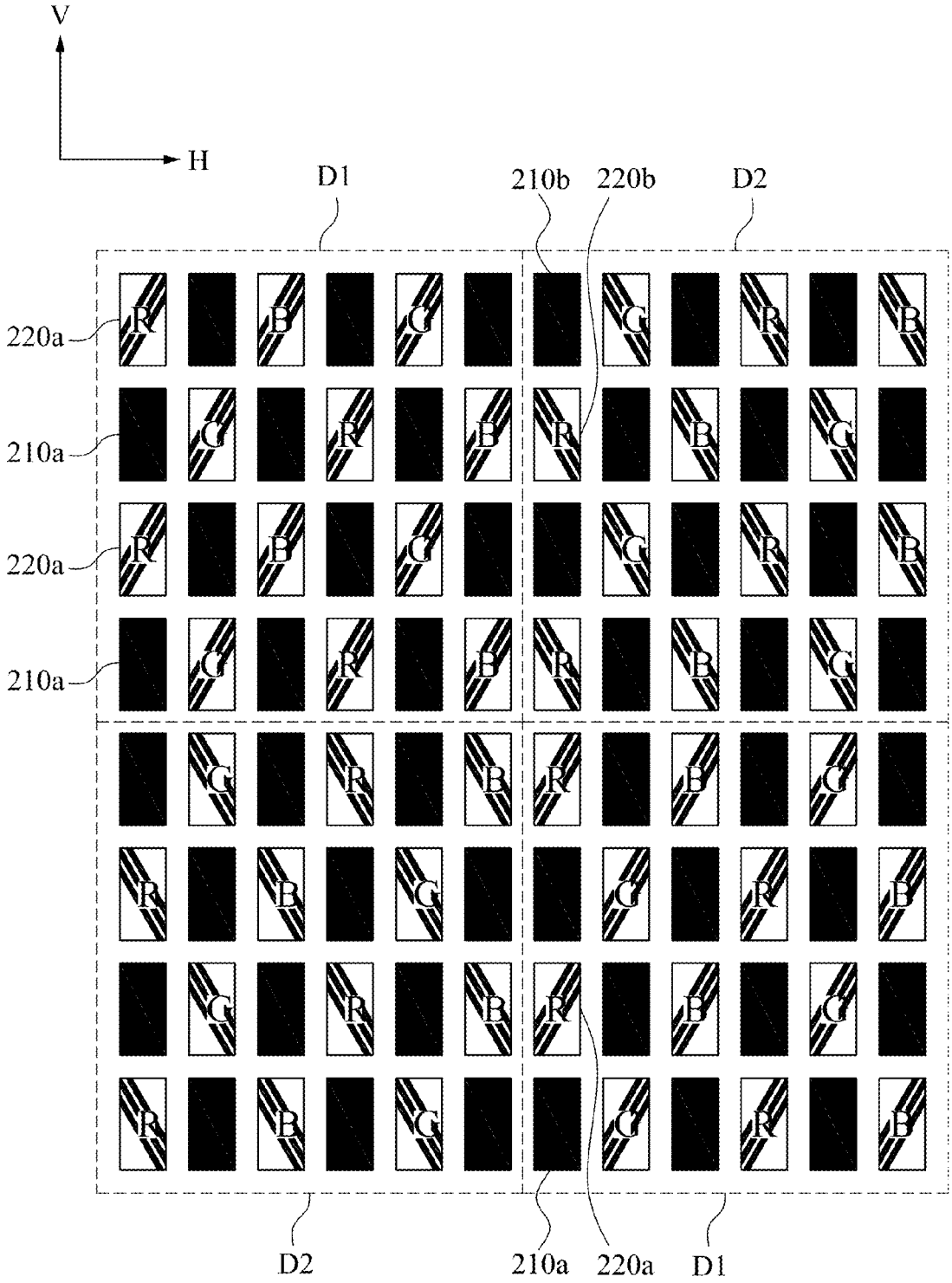
FIG. 6 is a top view schematically illustrating the display device with an adjustable viewing angle operated in the narrow viewing angle mode according to the first embodiment of the present disclosure.

FIG. 6 is a top view schematically illustrating the display device 100 with an adjustable viewing angle operated in the narrow viewing angle mode according to the first embodiment of the present disclosure. In this embodiment, when the display device 100 is set to be operated in the narrow viewing angle mode, the first on-axis brightness at the first gray level of the first pixels 210*a* in the first display areas D1 and the first on-axis brightness at the first gray level of the first pixels 210*b* in the second display area D2 have the brightness value at the gray level of 0. In FIG. 6, the black blocks represent the first pixels 210*a* and 210*b* at the gray level of 0 in the first display areas D1 and the second display area D2. Therefore, the on-axis brightness of the first sub-pixels 210*a* in the narrow viewing angle mode in FIG. 6 is substantially less than that at the predetermined gray level of the first sub-pixels 210*a* in the wide viewing angle mode in FIG. 1A. Similarly, the on-axis brightness of the first sub-pixels 210*b* in the narrow viewing angle mode in FIG. 6 is substantially less to than that at the predetermined gray level of the first sub-pixels 210*b* in the wide viewing angle mode in FIG. 1A. Each of the second sub-pixels 220*a* and 220*b* in the first display areas D1 and the second display areas D2 still displays the respective brightness at the predetermined gray level in the wide viewing angle. The following Table 1 shows a part of a gray level table of a specific example of the first embodiment of the present disclosure. It should be noted that the third electrodes 330 of the second sub-pixels 220*a* in the first display areas D1 in FIG. 6 substantially extend towards the second direction F2. The third electrodes 330 of the second sub-pixels 220*b* in the second display area D2 substantially extend towards the first direction F1. Furthermore, the first direction F1 is not parallel with the second direction F2.

TABLE 1

| Predetermined gray level value at the wide viewing angle | First gray level of the first sub-pixels at the narrow viewing angle | Second gray level of the second sub-pixels at the narrow viewing angle |
|---|---|---|
| 0 | 0 | 0 |
| 1 | 0 | 1 |
| 2 | 0 | 2 |
| 3 | 0 | 3 |
| 4 | 0 | 4 |
| 5 | 0 | 5 |
| 6 | 0 | 6 |
| 7 | 0 | 7 |
| 8 | 0 | 8 |
| 9 | 0 | 9 |
| 10 | 0 | 10 |
| 11 | 0 | 11 |
| . | . | . |
| . | . | . |
| . | . | . |
| 251 | 0 | 251 |
| 252 | 0 | 252 |
| 253 | 0 | 253 |
| 254 | 0 | 254 |
| 255 | 0 | 255 |

Figure 7:
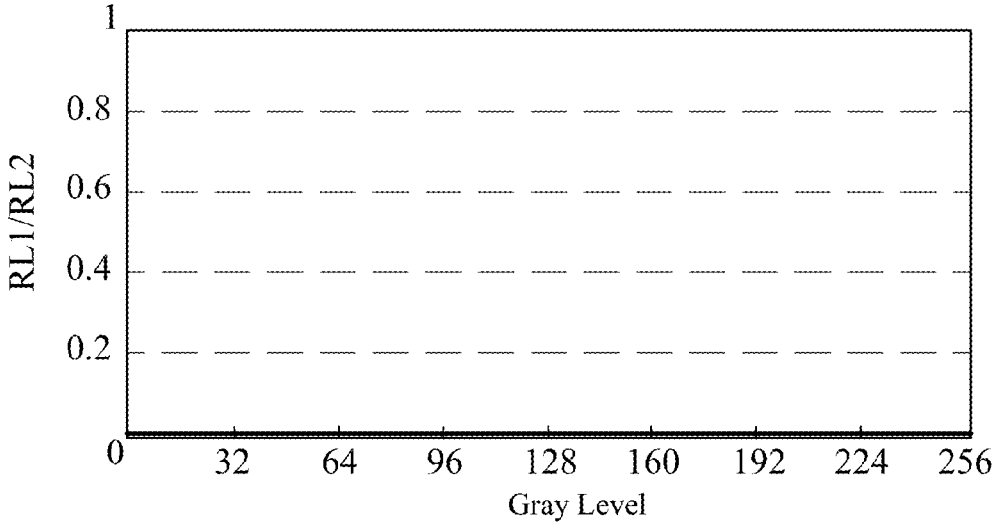
FIG. 7 is a diagram showing the ratio (RL1/RL2) of the relative on-axis brightness (RL1) of the first sub-pixels to the relative on-axis brightness (RL2) of the second sub-pixels in the narrow viewing angle mode at various predetermined gray levels according to the first embodiment.

FIG. 7 is a diagram showing the ratio (RL1/RL2) (unit: no) of the relative on-axis brightness (RL1) of the first sub-pixels 210*a* to the relative on-axis brightness (RL2) of the second sub-pixels 220*a* in the narrow viewing angle mode at various predetermined gray levels according to the first embodiment.

The relative on-axis brightness (RL) of the aforesaid sub-pixels is calculated by the following mathematic formula (I):

$$RL=(L_G-L_0)/(L_{255}-L_0) \quad \text{formula (I)}$$

wherein RL has no unit; and wherein $L_G$ represents the on-axis brightness at the gray level of G of the sub-pixels; $L_{255}$ represents the on-axis brightness at the gray level of 255 of the sub-pixels; and $L_0$ represents the on-axis brightness at the gray level of 0 of the sub-pixels.

Moreover, the relative side view brightness (RL) of the aforesaid sub-pixels is calculated through the utilization of the following mathematic formula (II):

$$RL_{side\text{-}view}=(L_{G_side\text{-}view}-L_0)/(L_{255}-L_0) \quad \text{mathematic formula (II)}$$

wherein $RL_{side\text{-}view}$ has no unit.

wherein $L_{G_side\text{-}view}$ represents the side view brightness at the gray level of G of the sub-pixels; $L_{255}$ represents the on-axis brightness at the gray level of 255 of the sub-pixels; and $L_0$ represents the on-axis brightness at the gray level of 0 of the sub-pixels. The relative side view brightness refers to the side view brightness relative to the on-axis brightness.

According to the embodiment of Table 1, in the narrow viewing angle mode, no matter which predetermined gray level the first sub-pixels 210*a* are located, the gray level value is 0. Therefore, the relative on-axis brightness of the first sub-pixels 210*a* is 0, and thus at each of the predetermined gray levels from 1 to 255 in FIG. 7, the value of the ratio (RL1/RL2) is 0. It should be noted that the ratio of FIG. 7 takes the ratio RL1/RL2 as an example, and either RL1/RL2 or RL2/RL1 may be used. The judgment way is based on that the ratio of RL1 to RL2 is not infinite. Moreover, in use at each of the gray levels, the ratio relationship of RL1/RL2 is not changed. Alternatively, in use at each of the gray levels, the ratio relationship of RL2/RL1 is not changed.

Figure 8A:
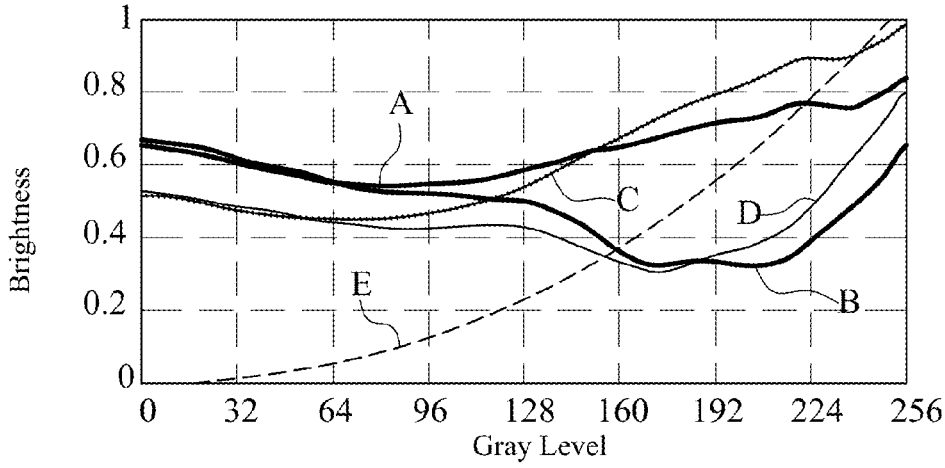
FIGS. 8A, 8B and 8C are diagrams showing the gray level brightness of the display device at various azimuth angles according to the first embodiment of the present disclosure.
Figure 8B:
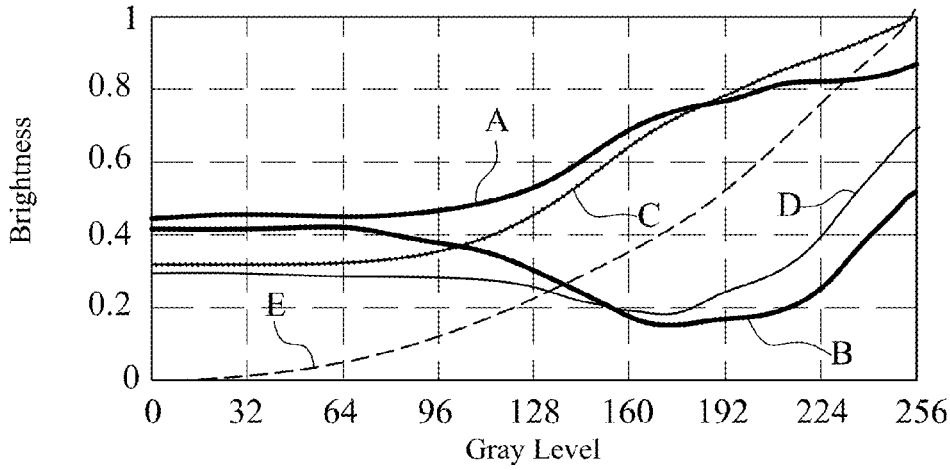
Figure 8C:
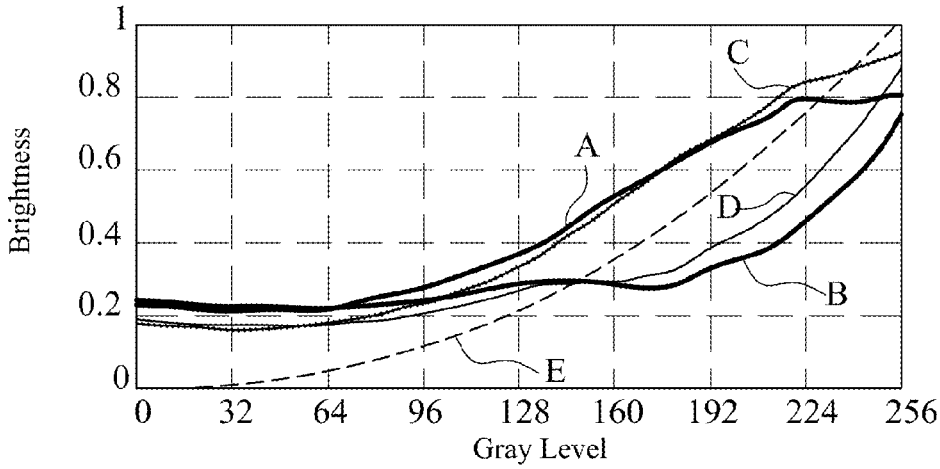

FIGS. 8A, 8B and 8C are diagrams showing the gray level brightness of the display device at various azimuth angles according to the first embodiment of the present disclosure. In FIGS. 8A, 8B and 8C, the longitudinal axes are the brightness value (unit: no) obtained from the normalization of the maximum on-axis brightness, and the horizontal axes are the gray level values (unit: no). In FIG. 8A, the curve A is the gray level brightness curve of the first display area D1 at the azimuth angle of about 45 degrees and at the zenith angle (side view angle) of about 60 degrees. The curve B is the gray level brightness curve of the second display area D2 at the zenith angle of about 60 degrees and the azimuth angle of about 45 degrees. The curve C is the gray level brightness curve of the first display area D1 at the azimuth angle of about 45 degrees and the zenith angle of about 45 degrees. The curve D is the gray level brightness curve of the second display area D2 at the azimuth angle of about 45 degrees and the zenith angle of about 45 degrees. The curve E is the gray level brightness curve in the normal view (i.e., in the direction normal to the panel). It can be seen from the results of FIG. 8A that the display device can have the gray level brightness curve approaching Gamma 2.2 in the normal view. In the normal view, a user can observe the displayed information on the display device. However, the display device has the anti-peep effect at the azimuth angle of about 45 degrees (the zenith angle is about 45 degrees or about 60 degrees).

In FIG. 8B, the curve A is the gray level brightness curve of the first display area D1 at the azimuth angle of about 0 degrees and the zenith angle (side view angle) of about 60 degrees. The curve B is the gray level brightness curve of the second display area D2 at the zenith angle of about 60 degrees and the azimuth angle of about 0 degrees. The curve C is the gray level brightness curve of the first display area D1 at the azimuth angle of about 0 degrees and the zenith angle of about 45 degrees. The curve D is the gray level brightness curve of the second display area D2 at the azimuth angle of about 0 degrees and the zenith angle of about 45 degrees. The curve E is the gray level brightness curve in the normal view (i.e., in the direction normal to the panel). It can be seen from the results of FIG. 8B that the display device also has the anti-peep effect at the azimuth angle of about 0 degrees (the zenith angle is about 45 degrees or about 60 degrees).

In FIG. 8C, the curve A is the gray level brightness curve of the first display area D1 at the azimuth angle of about 315 degrees and the zenith angle (side view angle) of about 60 degrees. The curve B is the gray level brightness curve of the second display area D2 at the zenith angle of about 60 degrees and the azimuth angle of about 315 degrees. The curve C is the gray level brightness curve of the first display area D1 at the azimuth angle of about 315 degrees and the zenith angle of about 45 degrees. The curve D is the gray level brightness curve of the second display area D2 at the azimuth angle of about 315 degrees and the zenith angle of about 45 degrees. The curve E to is the gray level brightness curve in the normal view (i.e., in the direction normal to the panel). It can be seen from the results of FIG. 8C that the display device also has the anti-peep effect at the azimuth angle of about 315 degrees (the zenith angle is about 45 degrees or about 60 degrees).

The results of FIGS. 8A, 8B and 8C can prove that the display device according to the first embodiment of the present disclosure has the anti-peep effect at any one of the azimuth angles.

Second Embodiment

Figure 9:
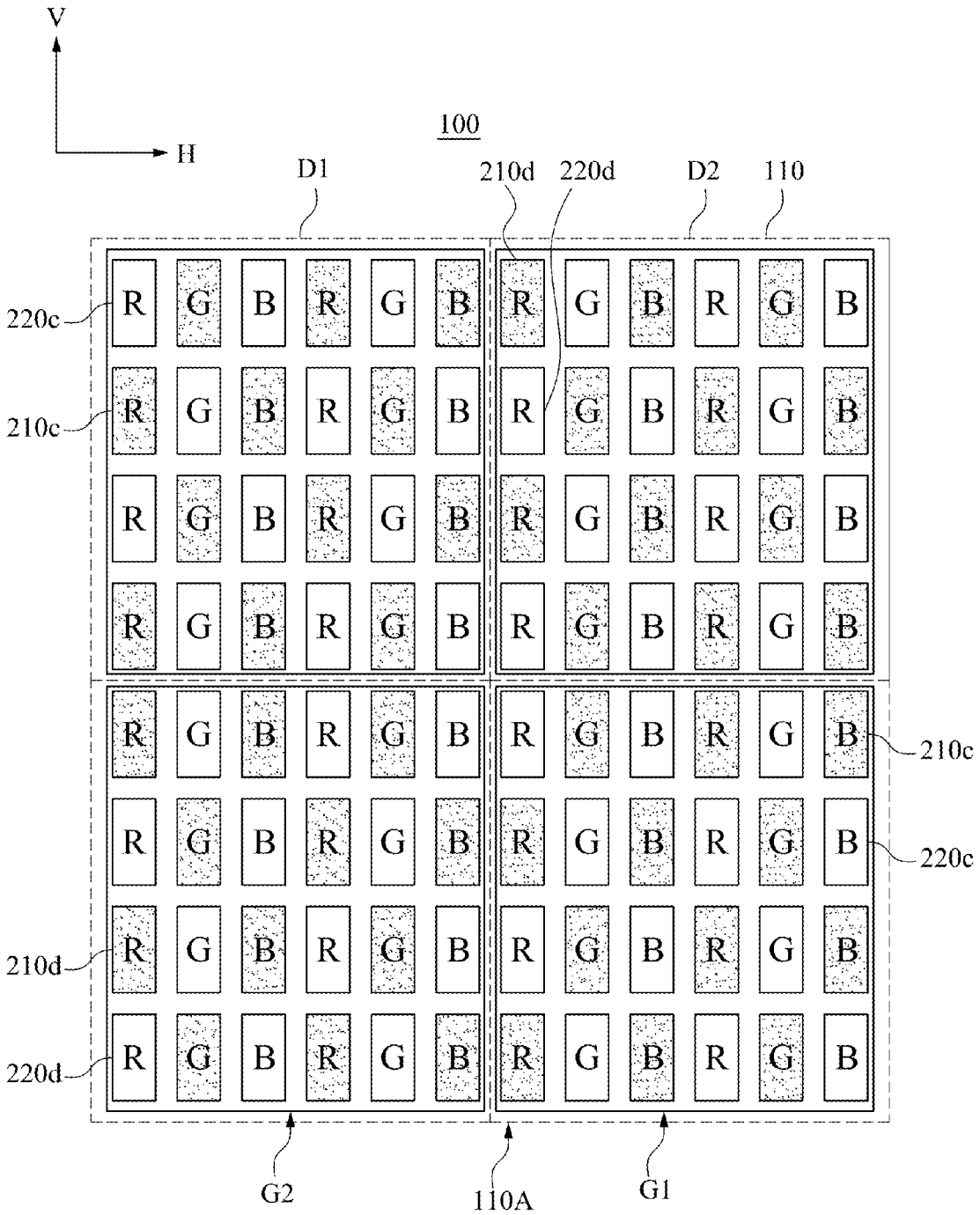
FIG. 9 is a top view schematically illustrating a display device 100 with an adjustable viewing angle operated in a narrow viewing angle mode according to a second embodiment of the present disclosure.

FIG. 9 is a top view schematically illustrating a display device 100 with an adjustable viewing angle operated in a narrow viewing angle mode according to a second embodiment of the present disclosure. The characteristics and the implementations of the panel 110 according to the second embodiment can be the same with those according to the first embodiment. The wide viewing angle mode according to the second embodiment still can refer to FIG. 1A.

When the display device 100 is operated in the narrow viewing angle mode, as shown in FIG. 9, the sum of the first on-axis brightness at the first gray level of the first sub-pixels 210*c* and the second on-axis brightness at the second gray level of the second sub-pixels 220*c* in the first display areas D1 under the narrow viewing angle mode is substantially equal to the sum of the on-axis brightness (i.e., the brightness in the normal viewing direction) at the predetermined gray level of the first sub-pixels 210*a* and that of the second sub-pixels 220*a* in the first display areas D1 under the wide viewing angle mode (referring to FIG. 1A). For example, the first on-axis brightness (expressed by lattice points) at the first gray level of the first sub-pixel 210*c* at the narrow viewing angle is substantially less than the on-axis brightness at the predetermined gray level of the same sub-pixel at the wide viewing angle. However, the second on-axis brightness (expressed by the fully white) at the second gray level of the second sub-pixel 220*c* is substantially greater than or equal to the on-axis brightness at the predetermined gray level of the same sub-pixel at the wide viewing angle. Therefore, the sum of the on-axis brightness of the first sub-pixel 210*c* and the second sub-pixel 220*c* in FIG. 9 is enabled to be substantially equal to that of the first sub-pixel 210*a* and the second sub-pixel 220*a* in FIG. 1A. Similarly, in the second display areas D2, the first on-axis brightness (expressed by the lattice points) at the first gray level of the first sub-pixel 210*d* at the narrow viewing angle is substantially less than the on-axis brightness at the predetermined gray level of the same sub-pixel at the wide viewing angle. However, the second on-axis brightness (expressed by the fully white) at the second gray level of the second sub-pixel 220*d* is substantially greater than or equal to the on-axis brightness at the predetermined gray level of the same sub-pixel at the wide viewing angle. Therefore, the sum of the first on-axis brightness at the first gray level of the first sub-pixel 210*d* and the second on-axis brightness at the second gray level of the second sub-pixel 220*d* in the second display areas D2 under the narrow viewing angle mode is substantially equal to the sum of the on-axis brightness at the predetermined gray levels of the first sub-pixel 210*b* and the second sub-pixel 220*b* in the second display areas D2 under the wide viewing angle mode (referring to FIG. 1A).

Figure 11:
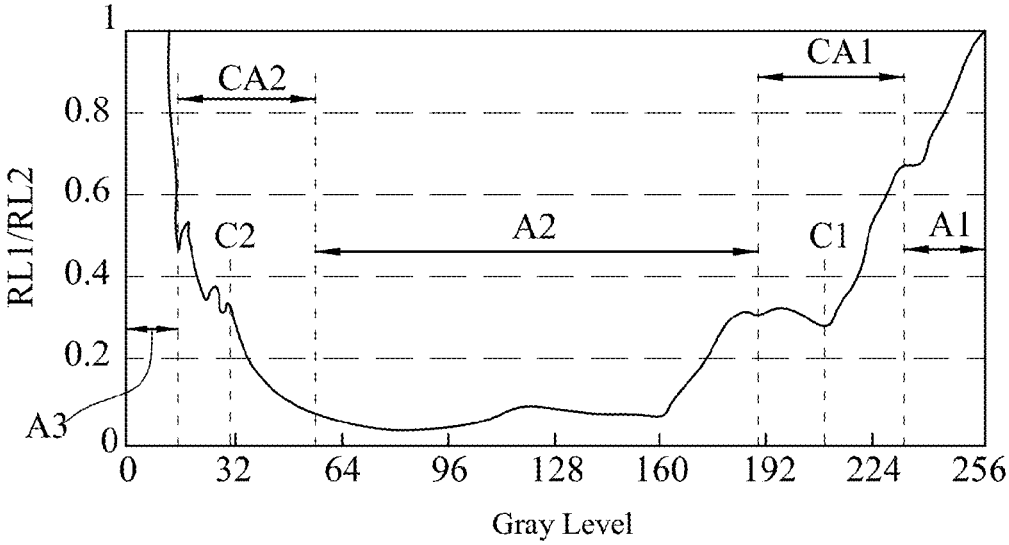
FIG. 11 is a diagram showing the ratio (RL1/RL2) of the relative on-axis brightness (RL1) of the first sub-pixels to the relative on-axis brightness (RL2) of the second sub-pixels in the narrow viewing angle mode at various predetermined gray levels according to the second embodiment of the present disclosure.

FIG. 11 is a diagram showing the ratio (unit: no) of the relative on-axis brightness RL1 (unit: no) of the first sub-pixels 210*c* to the relative on-axis brightness RL2 (unit: no) of the second sub-pixels 220*c* in the narrow viewing angle mode at various predetermined gray levels according to the second embodiment of the present disclosure. It should be noted that the ratio of FIG. 11 takes RL1/RL2 as a descriptive example, and either RL1/RL2 or RL2/RL1 may be used. The judgment way is based on that the ratio of RL1 to RL2 is not infinite. Moreover, in use at each of the gray levels, the ratio relationship of RL1/RL2 is not changed again. Alternatively, in use at each of the gray levels, the ratio relationship of RL2/RL1 is not changed again. The aforesaid predetermined gray level can optionally be the predetermined gray level of the first sub-pixels 210*c* at the wide viewing angle or the predetermined gray level of the second sub-pixels 220*c* at the wide viewing angle. Specifically, the gray level of the first sub-pixels 210*c* at the narrow viewing angle is referred to as the first gray level, and the gray level of the second sub-pixels 220*c* at the narrow viewing angle is referred to as the second gray level. As shown in FIG. 11, when the display device 100 is operated in the narrow viewing angle mode, the ratio (RL1/RL2) of the first relative on-axis brightness (RL1) at the first gray level to the second relative on-axis brightness (RL2) at the second gray level, corresponding to the on-axis brightness at any predetermined gray level greater than the first critical value C1, is substantially ranged from 0.3 to 1. Alternatively, the ratio (RL2/RL1) of the second relative on-axis brightness (RL2) at the second gray level to the first relative on-axis brightness (RL1) at the first gray level is substantially ranged from about 0.3 to about 1. In a specific example, the first critical value C1 is an integer between 192 and 232. In other words, when the predetermined gray level of the first sub-pixel (or the second to sub-pixel) is greater than the first critical value, the ratio of the relative on-axis brightness of the first sub-pixels 210*c* to the relative on-axis brightness of the second sub-pixels 220*c* is from about 0.3 to about 1.

Furthermore, in the narrow viewing angle mode, the ratio of the first on-axis brightness at the first gray level to the second on-axis brightness at the second gray level, corresponding to the on-axis brightness at any predetermined gray level between the first critical value C1 and the second critical value C2, is substantially ranged from 0 to 0.3, as shown in FIG. 11. In a specific example, the second critical value C2 is an integer substantially ranged from 10 to 50. In other words, when the predetermined gray level of the first sub-pixel (or the second sub-pixel) in the wide viewing angle mode is located between the critical value C1 and the second critical value C2, the ratio (RL1/RL2) of the relative on-axis brightness (RL1) of the first sub-pixels 210*c* to the relative on-axis brightness (RL2) of the second sub-pixels 220*c* is ranged from about 0 to about 0.3.

In addition, in the narrow viewing angle mode, the ratio (RL1/RL2) of the relative on-axis brightness (RL1) at the first gray level to the relative on-axis brightness (RL2) at the second gray level, corresponding to the on-axis brightness at any predetermined gray level between the second critical value C2 and 0, is substantially ranged from about 0.1 to about 1. Alternatively, the ratio (RL2/RL1) of the relative on-axis brightness (RL2) at the second gray level to the relative on-axis brightness (RL1) at the first gray level is substantially ranged from about 0.1 to about 1. In other examples, in the narrow viewing angle mode, there exists at least one predetermined gray level between 0 and to the second critical value such that the ratio of the first relative on-axis brightness at the first gray level to the second relative on-axis brightness at the second gray level is 0; and there exists another predetermined gray level such that the ratio of the first on-axis brightness at the first gray level to the second on-axis brightness at the second gray level is 0.

In order to describe the aforesaid technical contents in detail, Table 2 below shows a part of the gray level table of a specific example of the second embodiment of the present disclosure.

TABLE 2

| Predetermined gray level value at the wide viewing angle | First gray level of the first sub-pixels at the narrow viewing angle | Second gray level of the second sub-pixels at the narrow viewing angle |
|---|---|---|
| 0 | 0 | 0 |
| 1 | 1 | 1 |
| 2 | 1 | 3 |
| 3 | 3 | 3 |
| 4 | 4 | 4 |
| 5 | 2 | 7 |
| 6 | 3 | 8 |
| 7 | 2 | 10 |
| 8 | 1 | 12 |
| 9 | 5 | 12 |
| 10 | 8 | 12 |
| 11 | 10 | 12 |
| . | . | . |
| . | . | . |
| . | . | . |
| 90 | 23 | 123 |
| 91 | 24 | 124 |
| 92 | 24 | 125 |
| 93 | 24 | 127 |
| 94 | 25 | 128 |
| 95 | 26 | 129 |
| 96 | 26 | 131 |
| 97 | 28 | 132 |
| 98 | 28 | 133 |
| 99 | 28 | 135 |
| 100 | 30 | 136 |
| . | . | . |
| . | . | . |
| . | . | . |
| 250 | 241 | 255 |
| 251 | 243 | 255 |
| 252 | 245 | 255 |
| 253 | 247 | 255 |
| 254 | 249 | 255 |
| 255 | 255 | 255 |

In the specific example shown in table 2, at the high gray levels, the first gray level values of the first sub-pixels approach the second gray level values of the second sub-pixels. Therefore, the ratio ((RL1/RL2) or (RL2/RL1)) of the first relative on-axis brightness (RL1) at the first gray level to the second relative on-axis brightness (RL2) at the second gray level is greater than about 0.3 (referring to FIG. 11). At the middle gray levels, the first gray level values of the first sub-pixels are significantly less than the second gray level values of the second sub-pixels. Therefore, the ratio ((RL1/RL2) or (RL2/RL1)) of the first relative on-axis brightness (RL1) at the first gray level to the second relative on-axis brightness (RL2) at the second gray level is less than about 0.3. At the low gray levels, the first gray level values of the first sub-pixels and the second gray level values of the second sub-pixels are varied. However, at most of the predetermined gray levels, the ratio ((RL1/RL2) or (RL2/RL1)) of the first relative on-axis brightness (RL1) at the first gray level to the second relative on-axis brightness (RL2) at the second gray level is substantially ranged from about 0.1 to about 1.

Figure 12:
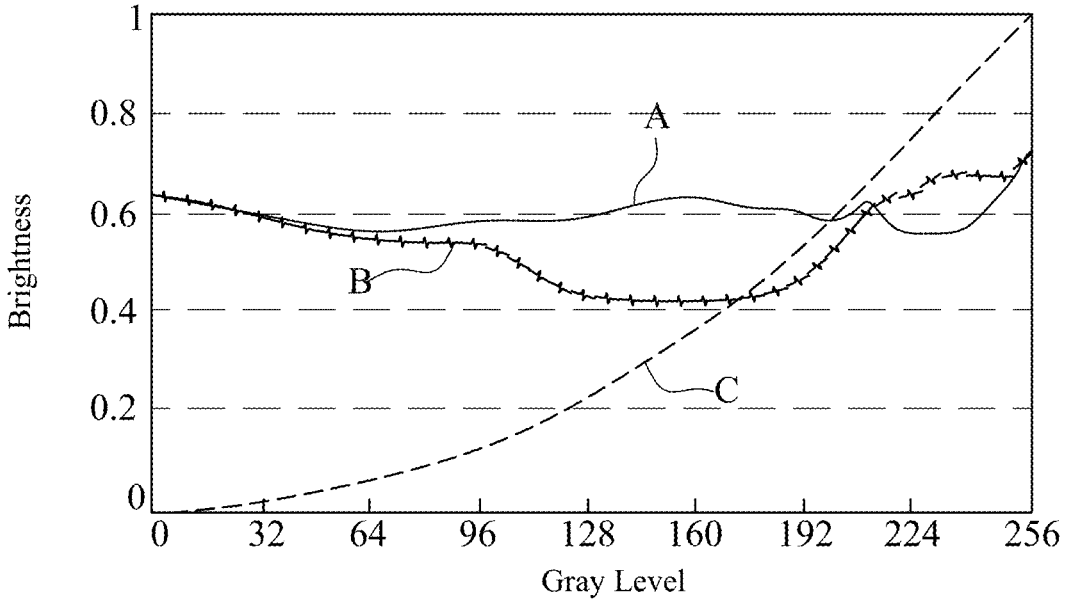
FIG. 12 is a diagram showing the gray level brightness of the display device, measured in a normal view and in a side view, according to the second embodiment of the present disclosure.

FIG. 12 is a diagram showing the gray level brightness of the display to device, measured in a normal view and in a side view, according to the second embodiment of the present disclosure. In FIG. 12, curve A is the gray level brightness curve of the first display areas D1 at the zenith angle (side view angle) of about 60 degrees. Curve B is the gray level brightness curve of the second display areas D2 at the zenith angle (side view angle) of about 60 degrees. The curve C is the gray level brightness curve in the normal view (i.e., in a direction normal to the panel). It can be seen from the results of FIG. 12 that the display device can have the gray level brightness curve approaching Gamma 2.2 in the normal view. The user can observe the displayed information on the display device in the normal view. Significantly, the display device has the anti-peep effect in the side view.

In another specific example, the display device 100 as shown in FIG. 9 includes a pixel array 110A. This pixel array 110A at least includes a first pixel group G1 and a second pixel group G2. The first pixel group G1 includes at least one first sub-pixel 210*c* and at least one second sub-pixel 220*c* respectively. The second pixel group G2 includes at least one first sub-pixel 210*d* and at least one second sub-pixel 220*d*. The first sub-pixel 210*c* includes a plurality of first electrodes 420 which are substantially parallel with each other, as shown in FIG. 10. The second sub-pixel 220*c* includes a plurality of second electrodes 410 which are substantially parallel with each other. However, the second electrodes 410 are not parallel with the first electrodes 420. The first sub-pixel 210*d* and the second sub-pixel 220*d* in the second pixel group G2 also include the structures similar to the first electrodes 420 and the second electrodes 410 respectively.

Reference is made to FIG. 11. When the display device 100 is operated in the wide viewing angle mode, each of the first sub-pixels 210*c* and the second sub-pixels 220*c* have a brightness at a predetermined gray level from 0 to 255. In fact, each of the gray levels in FIG. 11 corresponds to a brightness value. The brightness at the predetermined gray level from 0 to 255 has a first critical range CA1 and a second critical range CA2. The first critical range CA1 is substantially the brightness range corresponding to the gray levels from 192 to 232. The second critical range CA2 is substantially the brightness range corresponding to the gray levels from 10 to 50. The first critical range CA1 and the second critical range CA2 divide the brightness range of the predetermined gray level from 0 to 255 into a first range A1, a second range A2 and a third range A3. The first critical range CA1 is between the first range A1 and the second range A2. The second critical range CA2 is between the second range A2 and the third range A3.

When the display device 100 is operated in the narrow viewing angle mode, one of the following can be selected:

(a) when the on-axis brightness at the gray levels of the first sub-pixel 210*c* and the second sub-pixel 220*c* is located the first range A1, the ratio ((RL1/RL2) or (RL2/RL1)) of the on-axis brightness at the gray level of the first sub-pixel to the on-axis brightness at the gray level of the second sub-pixel is substantially ranged from 0.3 to 1;

(b) when the on-axis brightness at the gray levels of the first sub-pixel 210*c* and the second sub-pixel 220*c* is located in the second range A2, the ratio of the on-axis brightness at the gray level of the first sub-pixel to the on-axis brightness at the gray level of the second sub-pixel is substantially ranged from 0 to 0.3; and (c) when the on-axis brightness at the gray levels of the first sub-pixel 210*c* and the second sub-pixel 220*c* is located in the third range A3, the ratio of the on-axis brightness at the gray level of the first sub-pixels to the on-axis brightness at the gray level of the second sub-pixels is substantially ranged from 0.1 to 1.

In yet another specific example, the first range A1 is substantially an on-axis brightness range corresponding to the gray level ranged from 212 to 255, the second range A2 is substantially an on-axis brightness range corresponding to the gray level ranged from 31 to 211, and the third range A3 is substantially an on-axis brightness range corresponding to the gray level ranged from 0 to 30.

When the display device 100 is operated in the narrow viewing angle mode, as shown in FIG. 9, the sum of the on-axis brightness at the gray levels of the first sub-pixel 210*c* and the second sub-pixel 220*c* in the first pixel group G1 under the narrow viewing angle mode is substantially equal to the sum of the on-axis brightness at the gray levels of the first sub-pixel 210*c* and the second sub-pixel 220*c* in the first pixel group G1 under the wide viewing angle mode. Similarly, the sum of the on-axis brightness at the gray levels of the first sub-pixel 210*d* and the second sub-pixel 220*d* in the second pixel group G2 under the narrow viewing angle mode is substantially equal to the sum of the on-axis brightness at the gray levels of the first sub-pixel 210*d* and the second sub-pixel 220*d* in the second pixel group G2 under the wide viewing angle mode. That is, the sum of the on-axis brightness of the first sub-pixels and the second sub-pixels in any one of the first pixel group and the second pixel group in the narrow viewing angle mode is substantially equal to that in the wide viewing angle mode.

For example, the first on-axis brightness (expressed by lattice points) at the first gray level of the first sub-pixel 210*c* in the first pixel group G1 at the narrow viewing angle is substantially less than the on-axis brightness at the predetermined gray level of the same sub-pixels in the wide viewing angle mode. However, the second on-axis brightness (expressed by the fully white) at the second gray level of the second sub-pixels 220*c* is substantially greater than or equal to the on-axis brightness at the predetermined gray level of the same sub-pixels at the wide viewing angle. Therefore, the sum of the on-axis brightness of the first sub-pixel 210*c* and the second sub-pixel 220*c* in FIG. 9 under the narrow viewing angle mode is enabled to be substantially equal to that of the same first and second sub-pixels under the wide viewing angle mode. Similarly, in the second pixel group G2, the first on-axis brightness (expressed by the lattice points) at the first gray level of the first sub-pixel 210*d* at the narrow viewing angle is substantially less than the on-axis brightness at the predetermined gray level of the same sub-pixel at the wide viewing angle. However, the second on-axis brightness (expressed by the fully white) at the second gray level of the second sub-pixel 220*d* under the narrow viewing angle mode is substantially greater than or equal to the on-axis brightness at the predetermined gray level of the same sub-pixel at the wide viewing angle. Therefore, the sum of the first on-axis brightness at the first gray level of the first sub-pixel 210*d* and the second on-axis brightness at the second gray level of the second sub-pixel 220*d* in the second display areas D2 under the narrow viewing angle mode is substantially equal to the sum of the on-axis brightness at the predetermined gray levels of the first sub-pixel 210*d* and the second sub-pixel 220*d* in the second display area D2 under the wide viewing angle mode. That is, the on-axis brightness at the gray level of the first sub-pixel in any one of the first pixel group and the second pixel group in the narrow viewing angle mode is substantially less than that in the wide viewing angle mode.

The structural features of the display device 100 of the second embodiment may be the same as that of the first embodiment. Referring back to FIG. 2A. The display device 100 of the second embodiment includes the first substrate 111, the second substrate 112 and the display medium layer 113. The second substrate 112 corresponds to the first substrate 111. The display medium layer 113 is made from non-self-luminous display medium materials. For example, liquid crystal material is intervened between the first substrate 111 and the second substrate 112 so as to form the panel 110, so that the first pixel group G1 and the second pixel group G2 in the pixel array 110A are defined on the panel 110. The first sub-pixel 210*c* further includes the third electrode 430 arranged (or namely disposed) in the first sub-pixel 210*c* on the first substrate 111. The third electrode 430 and the first electrodes 420 are spaced apart so that the third electrode 430 is not in contact with the first electrodes 420. The second sub-pixel 220*c* further include the fourth electrode 440 arranged (or namely disposed) in the second sub-pixels 220*c* on the first substrate 111. The fourth electrode 440 and the second electrodes 410 are spaced apart so that the fourth electrode 440 is not in contact with the second electrodes 410. The display device 100 further includes the fifth electrode 450 arranged (or namely disposed) in the first sub-pixel 210*c* on the second substrate 112 and in the second sub-pixel 220*c* on the second substrate 112. The fifth electrode 450 is to not in contact with the electrodes acted as the pixel electrodes. For example, (1) when the first electrodes 420 and the second electrodes 410 are used as the pixel electrodes of the sub-pixels and the third electrodes 430 and the fourth electrodes 440 are for example as the common electrodes, the fifth electrodes 450 are not in contact with the first electrodes 420 and the second electrodes 410. Alternatively, (2) when the third electrode 430 and the fourth electrode 440 are used as the pixel electrodes of the sub-pixels and the first electrodes 420 and the second electrodes 410 are for example as the common electrodes, the fifth electrode 450 is not in contact with the third electrode 430 and the fourth electrode 440. Furthermore, the fifth electrode 450 in all of the sub-pixels 210*c* and 220*c* are optionally contacted with each other or not. That is, the fifth electrodes 450 in all of the sub-pixels 210*c* and 220*c* optionally receive either substantially the same voltage or two different voltages.

Figure 13:
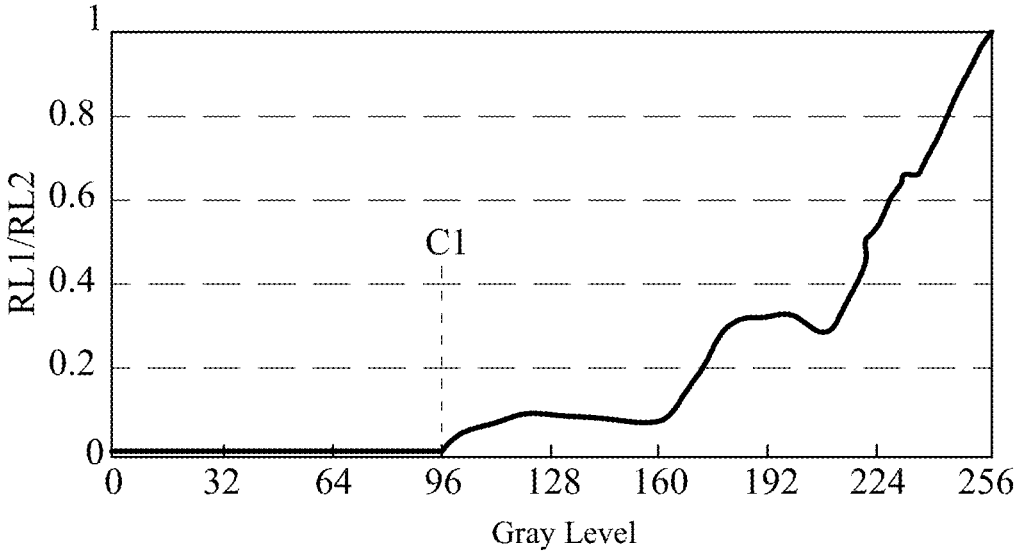
FIG. 13 is a diagram showing the ratio (RL1/TL2) of the relative on-axis brightness (RL1) of the first sub-pixels to the relative on-axis brightness (RL2) of the second sub-pixels in a narrow viewing angle mode at various predetermined gray levels according to a third embodiment of the present disclosure.

In addition, the extending directions of these first electrodes 420 of the first sub-pixels 210*c* and these second electrodes 410 of the second sub-pixels 220*c* in the first pixel group G1 substantially form a shape similar to "∨", "∧", "<" or ">", as shown in FIGS. 10 and 3A. The extending directions of these first electrodes 420 of the first sub-pixels 210*c* and these second electrodes 410 of the second sub-pixels 220*c* in the second pixel groups G2 substantially form a shape similar to "∨", "∧", "<" or ">", Third Embodiment The structural features of the display device with an adjustable viewing angle in the third embodiment of the present disclosure may be substantially the same as those described above in connection with the first embodiment or the second embodiment. FIG. 9 also refers to a top view schematically showing the display device with an adjustable viewing angle of the third embodiment, operated in the narrow viewing angle mode. The difference between the third embodiment and the first and second embodiments is that, in the narrow viewing angle mode, the ratio of the on-axis brightness (RL1) of the first sub-pixel 210*c* to the on-axis brightness (RL2) of the second sub-pixel 220*c* is different from that of the embodiments hereinbefore. FIG. 13 is a diagram showing the ratio (unit: no) of the relative on-axis brightness RL1 (unit: no) of the first sub-pixels 210*c* to the relative on-axis brightness RL2 (unit: no) of the second sub-pixels 220*c* in the narrow viewing angle mode at various predetermined gray levels. It should be noted that the ratio of RL1/RL2 in FIG. 13 is taken as a descriptive example, and either RL1/RL2 or RL2/RL1 may be used. The judgment way is based on that the ratio of RL1 to RL2 is not infinite. Moreover, in use at each of the gray levels, the ratio relationship of RL1/RL2 is not changed again. Alternatively, in use at each of the gray levels, the ratio relationship of RL2/RL1 is not changed again. The aforesaid predetermined gray level can optionally be the predetermined gray level of the first sub-pixels 210*c* at the wide viewing angle or the predetermined gray level of the second sub-pixels 220*c* at the wide viewing angle. As shown in FIG. 13, when the predetermined gray level is less than or equal to the first critical value C1, the value of (RL1/RL2) or (RL2/RL1) is 0. When the predetermined gray level is greater than the first critical value C1, the value of (RL1/RL2) or (RL2/RL1) begins to increase progressively. In FIG. 13, the first critical value C1 is the gray level of 96. Table 3 shows a part of the gray level of a specific example in the third embodiment of the present disclosure.

TABLE 3

| Predetermined gray level value at the wide viewing angle | First gray level of the first sub-pixels at the narrow viewing angle | Second gray level of the second sub-pixels at the narrow viewing angle |
|---|---|---|
| 0 | 0 | 0 |
| 1 | 0 | 1 |
| 2 | 0 | 2 |
| 3 | 0 | 3 |
| 4 | 0 | 4 |
| 5 | 0 | 5 |
| 6 | 0 | 6 |
| 7 | 0 | 7 |
| 8 | 0 | 8 |
| 9 | 0 | 9 |
| 10 | 0 | 10 |
| 11 | 0 | 11 |
| . | . | . |
| . | . | . |
| . | . | . |
| 96 | 0 | 96 |
| 97 | 28 | 132 |
| 98 | 28 | 133 |
| 99 | 28 | 135 |
| 100 | 30 | 136 |
| 101 | 32 | 137 |
| 102 | 33 | 138 |
| 103 | 34 | 139 |
| 104 | 34 | 141 |
| 105 | 36 | 142 |
| 106 | 37 | 143 |
| 107 | 38 | 144 |
| 108 | 39 | 145 |
| 109 | 39 | 147 |
| . | . | . |
| . | . | . |
| . | . | . |
| 210 | 143 | 255 |
| 211 | 146 | 255 |
| 212 | 149 | 255 |
| 213 | 152 | 255 |
| 214 | 155 | 255 |
| 215 | 158 | 255 |
| 216 | 161 | 255 |
| 217 | 163 | 255 |
| 218 | 166 | 255 |
| 219 | 169 | 255 |
| 220 | 173 | 254 |
| 221 | 174 | 255 |
| 222 | 186 | 255 |
| 223 | 189 | 255 |
| 224 | 191 | 255 |
| 225 | 194 | 255 |
| 226 | 196 | 255 |
| . | . | . |
| . | . | . |
| . | . | . |
| 255 | 255 | 255 |

In Table 3, the first critical value C1 is 96. When the predetermined gray level is in the range from 0 to 96, the first gray level value of the first sub-pixel is 0. From the predetermined gray level of 97, the first gray level value of the first sub-pixel is gradually increased. Therefore, the value of (RL1/RL2) or (RL2/RL1) corresponding to the gray level ranged from 0 to 96 in FIG. 13 is 0. Moreover, the value of (RL1/RL2) or (RL2/RL1) are gradually increased from the gray level of 97.

Figure 14:
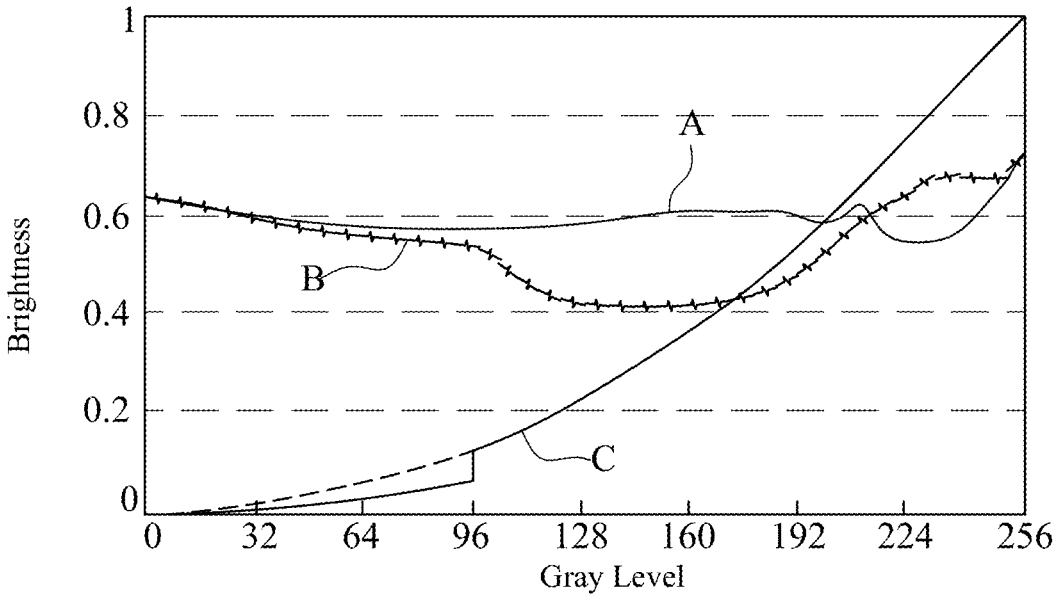
FIG. 14 is a diagram showing the gray level brightness of the display device, measured in a normal view and in a side view, according to the third to embodiment of the present disclosure.

FIG. 14 is a diagram showing the gray level brightness of the display device, measured in a normal view and in a side view, according to the third embodiment of the present disclosure. In FIG. 14, curve A is the gray level brightness curve of the first display area D1 at the zenith angle (side view angle) of about 60 degrees. The curve B is the gray level brightness curve of the second display area D2 at the zenith angle of about 60 degrees. The curve C is the gray level brightness curve in the normal view (i.e., in a direction normal to the panel). It should be noted that although the display device has the anti-peep effect in the side view, the gray level brightness curve in the normal view deviates from the curve of Gamma 2.2 (the curve of Gamma 2.2 is showed with dotted lines in FIG. 14) when the predetermined gray level is less than 96. Therefore, this deviation causes a poor image quality for the user in the normal view.

Fourth Embodiment

Figure 15:
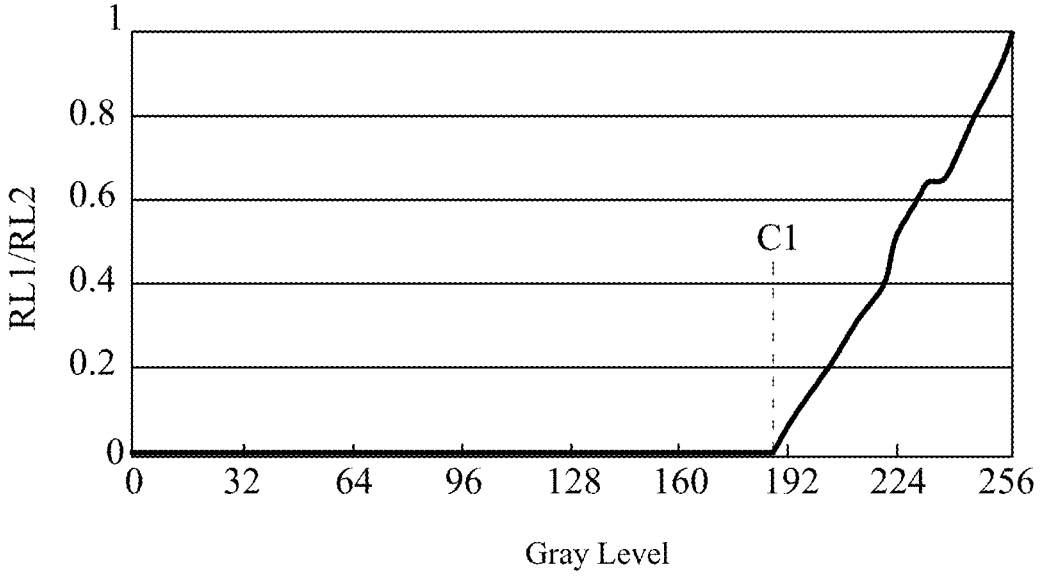
FIG. 15 is a diagram showing the ratio (RL1/RL2) of the relative on-axis brightness (RL1) of the first sub-pixels to the relative on-axis brightness (RL2) of the second sub-pixels in the narrow viewing angle mode at various predetermined gray levels according to a fourth embodiment of the present disclosure.

The structural features of the display device with an adjustable viewing angle in the fourth embodiment of the present disclosure may be substantially the same as those described above in connection with the first embodiment, the second embodiment or the third embodiment. FIG. 9 also refers to a top view schematically showing the display device with an adjustable viewing angle of the fourth embodiment, operated in the narrow viewing angle mode. The difference between the fourth embodiment and the first and second embodiments is that, in the narrow viewing angle mode, the ratio of the on-axis brightness (RL1) of the first sub-pixel 210*c* to the on-axis brightness (RL2) of the second sub-pixel 220*c* is different from that of the embodiments hereinbefore. FIG. 15 is a diagram showing the ratio (unit: no) of the relative on-axis brightness RL1 (unit: no) of the first sub-pixels 210*c* to the relative on-axis brightness RL2 (unit: no) of the second sub-pixels 220*c* in the narrow viewing angle mode at various predetermined gray levels. It should be noted that the ratio of RL1/RL2 in FIG. 15 is taken as a descriptive example, and either RL1/RL2 or RL2/RL1 may be used. The judgment way is based on that the ratio of RL1 to RL2 is not infinite. Moreover, in use at each of the gray levels, the ratio relationship of RL1/RL2 is not changed again. Alternatively, in use at each of the gray levels, the ratio relationship of RL2/RL1 is not changed again. The aforesaid predetermined gray level can be optionally the predetermined gray level of the first sub-pixels 210*c* at the wide viewing angle or the predetermined gray level of the second sub-pixels 220*c* at the wide viewing angle. As shown in FIG. 15, when the predetermined gray level is less than or equal to the first critical value C1, the value of (RL1/RL2) or (RL2/RL1) is 0. When the predetermined gray level is greater than the first critical value C1, the value of (RL1/RL2) or (RL2/RL1) begins to increase progressively. The first critical value is substantially one integer between 160 and 220. Specifically, the gray level of the first sub-pixel 210*c* at the narrow viewing angle is referred to as the first gray level, and the gray level of the second sub-pixel 220*c* at the narrow viewing angle is referred to as the second gray level. The ratio (RL1/RL2 or RL1/RL2) of the first on-axis brightness (RL1) at the first gray level to the second on-axis brightness (RL2) at the second gray level, corresponding to the on-axis brightness at any predetermined gray level less than the first critical value C1, is substantially 0. Moreover, the ratio (RL1/RL2 or RL1/RL2) of the first on-axis brightness (RL1) at the first gray level to the second on-axis brightness (RL2) at the second gray level, corresponding to the on-axis brightness at any predetermined gray level of greater than the first critical value C1, is substantially greater than 0, but less than or equal to 1.

In one specific example, in the narrow viewing angle mode, when the predetermined gray level is less than or equal to the first critical value C1, the corresponding first on-axis brightness at the first gray level is the brightness at the gray level of 0. When the predetermined gray level is greater than or equal to the first critical value C1, the corresponding second on-axis brightness at the second gray level is the brightness at the gray level of 255. The first critical value is substantially one integer between 160 and 220. In order to describe the technical contents in more detail, Table 4 shows a part of the gray level of a specific example in the fourth embodiment of the present disclosure.

TABLE 4

| Predetermined gray level value at the wide viewing angle | First gray level of the first sub-pixels at the narrow viewing angle | Second gray level of the second sub-pixels at the narrow viewing angle |
|---|---|---|
| 0 | 0 | 0 |
| 1 | 0 | 1 |
| 2 | 0 | 3 |
| 3 | 0 | 4 |
| 4 | 0 | 5 |
| 5 | 0 | 7 |
| 6 | 0 | 8 |
| 7 | 0 | 10 |
| 8 | 0 | 12 |
| 9 | 0 | 12 |
| 10 | 0 | 14 |
| 11 | 0 | 15 |
| . | . | . |
| . | . | . |
| . | . | . |
| 188 | 0 | 255 |
| 189 | 40 | 255 |
| 190 | 50 | 255 |
| 191 | 59 | 255 |
| 192 | 66 | 255 |
| 193 | 72 | 255 |
| 194 | 78 | 255 |
| 195 | 84 | 255 |
| 196 | 89 | 255 |
| 197 | 95 | 255 |
| 198 | 99 | 255 |

TABLE 4-continued

| Predetermined gray level value at the wide viewing angle | First gray level of the first sub-pixels at the narrow viewing angle | Second gray level of the second sub-pixels at the narrow viewing angle |
|---|---|---|
| . | . | . |
| . | . | . |
| . | . | . |
| 246 | 232 | 255 |
| 247 | 233 | 255 |
| 248 | 237 | 255 |
| 249 | 239 | 255 |
| 250 | 240 | 255 |
| 251 | 243 | 255 |
| 252 | 245 | 255 |
| 253 | 247 | 255 |
| 254 | 248 | 255 |
| 255 | 255 | 255 |

In the example of Table 4, the first critical value is 188. When the predetermined gray level value is substantially less than or equal to 188, the first gray level value of the first sub-pixel is 0. When the predetermined gray level value is substantially greater than 188, the second gray level value of the second sub-pixel is 255. Therefore, the value of (RL1/RL2) or (RL1/RL2) corresponding to the gray level ranged from 0 to 188 in FIG. 15 is 0. Moreover, the value of (RL1/RL2) or (RL1/RL2) begins to increase gradually from the gray level of 189.

Figure 16:
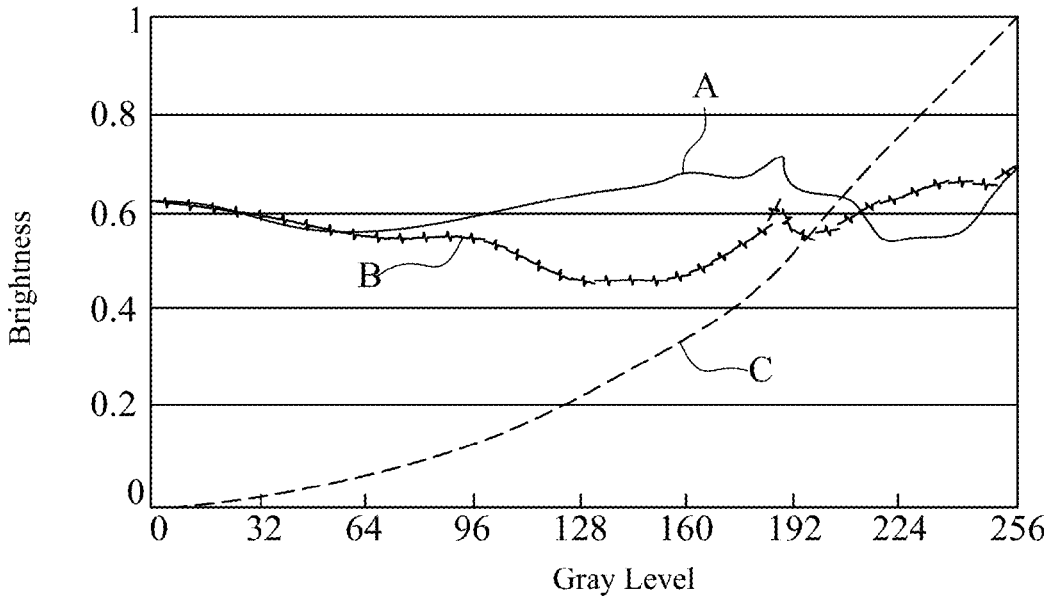
FIG. 16 is a diagram showing the gray level brightness of the display device, measured in a normal view and in a side view, according to the fourth embodiment of the present disclosure.

FIG. 16 is a diagram showing the gray level brightness of the display device, measured in a normal view and in a side view, according to the fourth embodiment of the present disclosure. In FIG. 12, the curve A is the gray level brightness curve of the first display area D1 at the zenith angle (side view angle) of about 60 degrees. The curve B is the gray level brightness curve of the second display area D2 at the zenith angle (side view angle) of about 60 degrees. The curve C is the gray level brightness curve in the normal view (i.e., in a direction normal to the panel). It can be seen from the results of FIG. 16 that the display device can have the gray level brightness curve approaching to Gamma 2.2 in the normal view. The user can observe the displayed information on the display device in the normal view. Significantly, the display device has the anti-peep effect in the side view.

The contrast ratios at the zenith angle of about 60 degree in the first to fourth embodiments are summarized in Table 5, in which the contrast ratio is calculated by the average brightness of the first display area divided by the average brightness of the second display area.

TABLE 5

| | First Embodiment | Second Embodiment | Third Embodiment | Fourth Embodiment |
|---|---|---|---|---|
| Contrast Ratio | 1.1646 | 1.1691 | 1.1642 | 1.1551 |

In FIG. 5, when the contrast ratio is greater, the anti-peep effect in the side view is better. In the first to fourth embodiments, the second embodiment exhibits the best side view anti-peep effect.

Fifth Embodiment

Figure 17A:
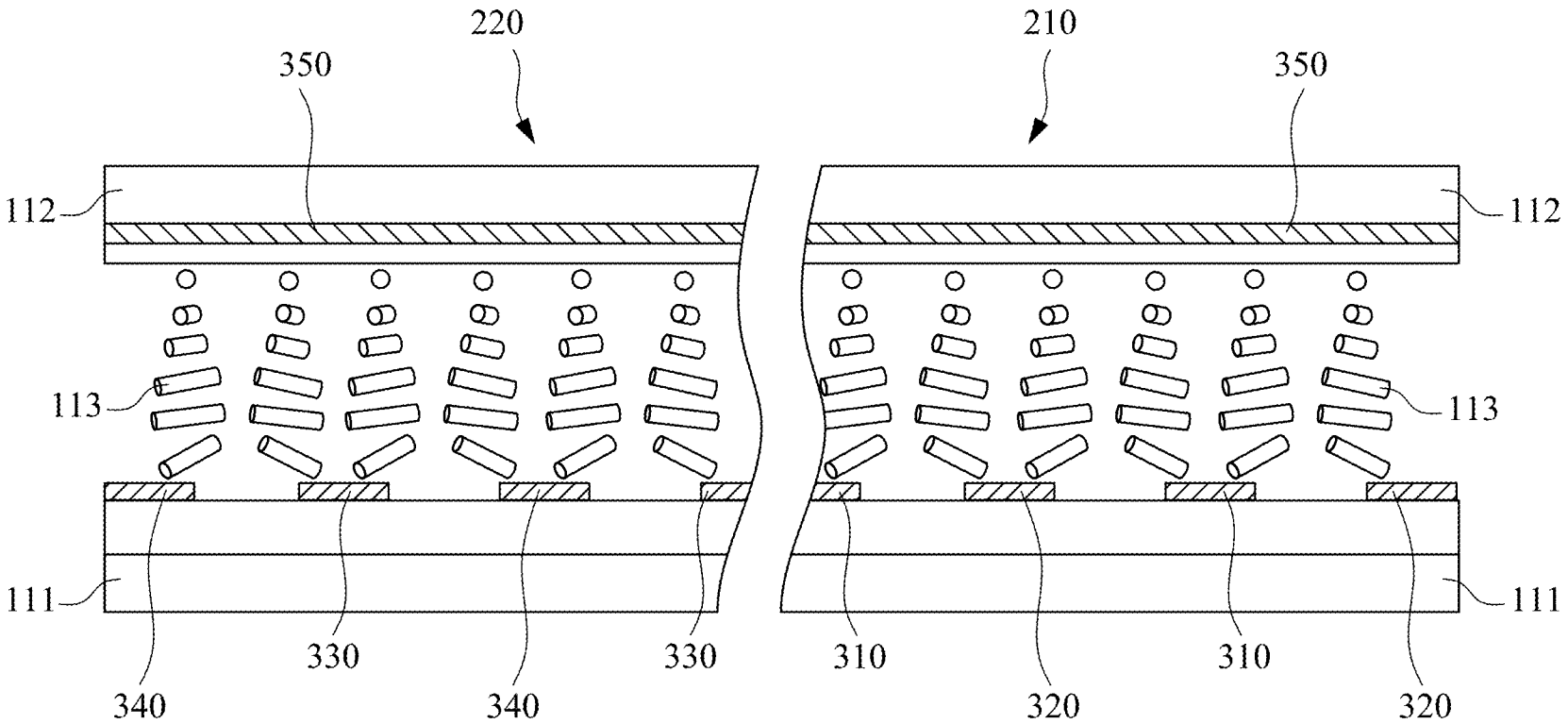
FIG. 17A is a cross-sectional view schematically illustrating a display device with an adjustable viewing angle according to a fifth embodiment of the present disclosure.

FIG. 17A is a cross-sectional view schematically illustrating a display device with an adjustable viewing angle according to a fifth embodiment of the present disclosure. The difference between this embodiment and the first embodiment (referring to FIG. 2A) is that the first electrodes 310 and the second electrodes 320 are arranged (or namely disposed) on substantially the same plane. Furthermore, the third electrodes 330 and the fourth electrodes 340 are arranged (or namely disposed) on the substantially same plane as well. In one specific example, the first electrodes 310 and the third electrodes 330 are the pixel electrodes of the first sub-pixel 210 and the second sub-pixel 220 respectively. The second electrodes 320 and the fourth electrodes 340 are the common electrodes of the first sub-pixel 210 and the second sub-pixel 220 respectively. The first electrodes 310 are substantially parallel with the second electrodes 320. The third electrodes 330 are substantially parallel with the fourth electrodes 340. Specifically, each of the first electrodes 310 and each of the second electrodes 320 are arranged in a staggering way (i.e. alternately arrangement). Also, each of the third electrodes 330 and each of the fourth electrodes 340 are arranged in a staggering way. Furthermore, the extending directions of the first electrodes 310 and the second electrodes 320 and the extending directions of the third electrodes 330 and the fourth electrodes 340 respectively form a shape similar to "∨", "∧", "<" or ">" as shown in FIGS. 3A, 3B and 10, for example. The top view outlines of the first electrodes 310, the second electrodes 320, the third electrodes 330 and the fourth electrodes 340 may be similar to the strip shape shown in FIG. 10. In other words, the arrangement of the first electrodes 310, the second electrodes 320, the third electrodes 330 and the fourth electrodes 340 may be similar to the electrode arrangement of an in-plane-switching (IPS) liquid crystal display device. However, in this embodiment, the fifth electrodes 350 are disposed on the second substrate and used for providing a perpendicular electric field between the first substrate 111 and the second substrate 112. The fifth electrodes 350 are not in contact with the electrodes acted as the pixel electrodes. For example, (1) when the first electrode 310 and the third electrode 330 are used as the pixel electrodes of the sub-pixels whereas the second electrodes 320 and the fourth electrodes 340 are used as the common electrodes, for example, the fifth electrodes 350 are not in contact with the first electrode 310 and the third electrode 330. Alternatively, (2) when the second electrode 320 and the fourth electrode 340 are used as the pixel electrodes of the sub-pixels whereas the first electrodes 310 and the third electrodes 330 are used as the common electrodes, for example, the fifth electrodes 350 are not in contact with the second electrode 320 and the fourth electrode 340. Furthermore, the fifth electrodes 350 in the sub-pixels 210 and 220 are optionally contacted with each other or not. That is, the fifth electrode 350 in the sub-pixels 210 and 220 optionally receive either substantially the same voltage or different voltages.

Figure 17B:
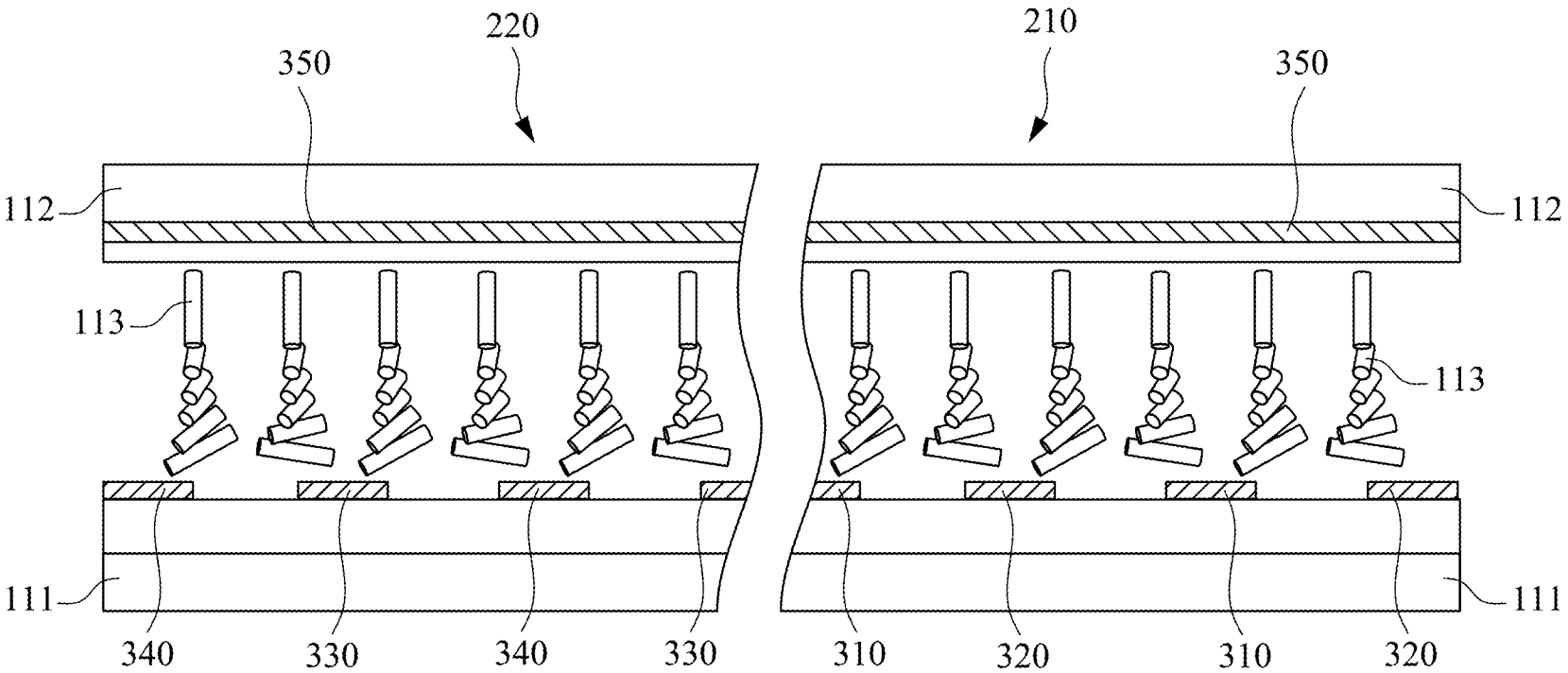
FIG. 17B illustrates a schematic view of the liquid crystal orientation in the display device with an adjustable viewing angle operated in a narrow viewing angle mode according to the fifth embodiment of the present disclosure.

In the embodiment in which the display medium layer 113 is liquid crystal molecules (the display medium layer 113 of the present disclosure is not limited to liquid crystal molecules), the orientation of the liquid crystal molecules in a wide viewing angle mode is schematically shown in FIG. 17A. On the other hands, when the display device 100 is operated in a narrow viewing angle mode, the orientation of the liquid crystal molecules is schematically shown in FIG. 17B. Therefore, the orientation and the torsion situation of the liquid crystal molecules 113 in the wide viewing angle mode shown in FIG. 17A from the first substrate 111 to the second substrate 112 are completely different from those of the liquid crystal molecules 113 in the narrow viewing angle mode shown in FIG. 17B from the first substrate 111 to the second substrate 112.

Since other relevant structures, driving modes and operation details can be the same with those of the first, second, third or fourth embodiment, no more repeated descriptions are given.

Another aspect of the present disclosure provides a method for driving a display device with an adjustable viewing angle.

In an embodiment, this method includes the steps described below. At first, a display device according to any one of the first, second, third, fourth, and fifth embodiments is provided. For example, the display device of the second embodiment can be provided. When the display device is operated in a wide viewing angle mode, the first and second sub-pixels respectively have an on-axis brightness at a predetermined gray level located between the level of 0 and the level of 255. The on-axis brightness at the predetermined gray level between the level of 0 and the level of 255 has a first critical range and a second critical range. As such, the on-axis brightness range at the predetermined gray level between the level of 0 and the level of 255 is divided into a first range, a second range and a third range. The first critical range is between the first range and the second range, and the second critical range is between the second range and the third range. The first critical range is substantially ranged from the gray level of 192 to the gray level of 232, and the second critical range is substantially ranged from the gray level of 10 to the gray level of 50. When the display device is operated in a narrow viewing angle mode, one of the following may be selected:

a) when the on-axis brightness at the gray levels of the first sub-pixel and the second sub-pixel is located in the first range, the ratio of the on-axis brightness at the gray level of the first sub-pixel to the on-axis brightness at the gray level of the second sub-pixel is substantially ranged from 0.3 to 1;

b) when the on-axis brightness at the gray levels of the first sub-pixel and the second sub-pixel is located in the second range, the ratio of the on-axis brightness at the gray level of the first sub-pixels to the on-axis brightness at the gray level of the second sub-pixels is substantially ranged from 0 to 0.3; and c) when the on-axis brightness at the gray levels of the first sub-pixel and the second sub-pixel is located in the third range, the ratio of the on-axis brightness at the gray level of the first sub-pixels to the on-axis brightness at the gray level of the second sub-pixels is substantially equal to 0.

In one specific example, the first range is substantially ranged from the gray level of 212 to the gray level of 255, the second range is substantially ranged from the gray level of 31 to the gray level of 211, and the third range is substantially ranged from the gray level of 0 to the gray level of 30.

In another specific example, a sum of the on-axis brightness at the gray levels of the first sub-pixels and the second sub-pixel in any one of the first pixel group and the second pixel group under the narrow viewing angle mode is substantially equal to a sum of the on-axis brightness at the gray levels of the first sub-pixel and the second sub-pixel in any one of the first pixel group and the second pixel group under the wide viewing angle mode.

In yet another specific example, the on-axis brightness at the gray level of the first sub-pixel in any one of the first pixel group and the second pixel group under the narrow viewing angle mode is substantially less than the on-axis brightness at the gray level of the first sub-pixel in any one of the first pixel group and the second pixel group under the wide viewing angle mode.

In another embodiment, the method includes the steps described below. At first, a display device according to any one of the first, second, third, fourth, and fifth embodiments is provided. For example, the display device of the fourth embodiment can be provided. When the display device is operated in a wide viewing angle mode, the first and second sub-pixels respectively have an on-axis brightness at a predetermined gray level located between the level of 0 and the level of 255. When the display device is operated in a narrow viewing angle, the on-axis brightness of the first sub-pixels is the brightness at the 0th gray level if the on-axis brightness of the first sub-pixels 210 and the second sub-pixels 220 is less than an on-axis brightness corresponding to a first critical gray level, in which the first critical gray level value is an integer from about 160 to about 220; if the on-axis brightness of the first sub-pixel 210 and the second sub-pixel 220 is greater than the on-axis brightness corresponding to the first critical gray level, the on-axis brightness of the second sub-pixel 220 is that at the gray level of 255.

Although the present disclosure has been disclosed with reference to the above embodiments, these embodiments are not intended to limit the present disclosure. It will be apparent to those skilled in the art that various modifications and variations can be made without departing from the scope or spirit of the present disclosure. Therefore, the scope of the present disclosure shall be defined by the appended claims.

What is claimed is:

1. A display device with an adjustable viewing angle, comprising:

a panel comprising a first substrate, a second substrate, and a display medium layer intervened between the first substrate and the second substrate;

at least one first display area and at least one second display area defined on the panel, wherein each of the first display area and the second display area at least comprises a first sub-pixel and a second sub-pixel adjacent to the first sub-pixel;

a first electrode and a second electrode spaced apart from the first electrode, wherein the first electrode and the second electrode are arranged in the first sub-pixel on the first substrate;

a third electrode and a fourth electrode spaced apart from the third electrode, wherein the third electrode and the fourth electrode are arranged in the second sub-pixel on the first substrate; and a fifth electrode arranged in the first sub-pixel on the second substrate and in the second sub-pixel on the second substrate;

wherein when the display device is operated in a wide viewing angle mode, the first and second sub-pixels each have an on-axis brightness at a predetermined gray level; and when the display device is operated in a narrow viewing angle mode, the first sub-pixel has an on-axis brightness at a first gray level and the second sub-pixel has an on-axis brightness at a second gray level, and wherein the on-axis brightness at the first gray level is substantially less than the on-axis brightness at the predetermined gray level of the first sub-pixel.

2. The display device of claim 1, wherein a sum of the on-axis brightness at the first gray level of the first sub-pixels and the on-axis brightness at the second gray level of the second sub-pixels in any one of the first display area and the second display area under the narrow viewing angle mode is substantially equal to a sum of the on-axis brightness at the predetermined gray level of the first sub-pixel and the on-axis brightness at the predetermined gray level of the second sub-pixels in any one of the first display area and the second display area under the wide viewing angle mode.

3. The display device of claim 1, wherein in the narrow viewing angle mode, the on-axis brightness at the first gray level of the first display area and the on-axis brightness at the first gray level of the second display area are of an on-axis brightness at a gray level of 0.

4. The display device of claim 1, wherein the on-axis brightness at the second gray level of the second sub-pixel in any one of the first display area and the second display area in the narrow viewing angle mode is substantially greater than or substantially equal to the on-axis brightness at the predetermined gray level of the second sub-pixel in any one of the first display area and the second display area in the wide viewing angle mode.

5. The display device of claim 4, wherein in the narrow viewing angle mode, the ratio of the on-axis brightness at the first gray level, that corresponds to an on-axis brightness at any of the predetermined gray level of greater than a first critical value, to the on-axis brightness at the second gray level is substantially ranged from 0.3 to 1, and wherein the first critical value is an integer substantially ranged from 192 to 232.

6. The display device of claim 5, wherein in the narrow viewing angle mode, the ratio of the on-axis brightness at the first gray level, that corresponds to an on-axis brightness at any of the predetermined gray level between the first critical value and a second critical value, to the on-axis brightness at the second gray is substantially ranged from 0 to 0.3, and wherein the second critical value is an integer substantially ranged between 10 and 50.

7. The display device of claim 6, wherein in the narrow viewing angle mode, the ratio of the on-axis brightness at the first gray level, that corresponds to an on-axis brightness at any one of the predetermined gray level between the second critical value and 0, to the on-axis brightness at the second gray level is substantially ranged from 0.1 to 1, alternatively the ratio of the on-axis brightness at the second gray level, that corresponds to an on-axis brightness at any one of the predetermined gray level between the second critical value and 0, to the on-axis brightness at the first gray level is substantially ranged from 0.1 to 1.

8. The display device of claim 4, wherein in the narrow viewing angle mode, the ratio of the on-axis brightness at the first gray level, that corresponds to an on-axis brightness at any one of the predetermined gray level less than a first critical value, to the on-axis brightness at the second gray level is substantially equal to 0, and wherein the ratio of the on-axis brightness at the first gray level, that corresponds to an on-axis brightness at any one of the predetermined gray level greater than the first critical value, to the on-axis brightness at the second gray level is substantially greater than 0 but less than or substantially equal to 1, and wherein the first critical value is an integer substantially ranged from 160 to 220.

9. The display device of claim 4, wherein in the narrow viewing angle mode, the on-axis brightness at the first gray level, that corresponds to an on-axis brightness at any one of the predetermined gray level less than a first critical value, is a brightness at a gray level of 0, and the on-axis brightness at the second gray level, that corresponds to an on-axis brightness at any of the predetermined gray level greater than the first critical value, is an on-axis brightness at a gray level of 255, wherein the first critical value is an integer substantially ranged between 160 and 220.

10. A display device with an adjustable viewing angle, comprising:

a pixel array at least comprising a first pixel group and a second pixel group, wherein each of the first and second pixel groups at least comprises a first sub-pixel and a second sub-pixel, wherein each the first sub-pixel comprises a plurality of first electrodes which are substantially parallel with each other; and each the second sub-pixel comprises a plurality of second electrodes which are substantially parallel with each other, but not parallel with the first electrodes which are substantially parallel with each other; wherein when the display device is operated in a wide viewing angle mode, each of the first and second sub-pixels has an on-axis brightness at a predetermined gray level between 0 and 255, wherein the on-axis brightness at the predetermined gray level between 0 and 255 has a first critical range and a second critical range such that the on-axis brightness at the predetermined gray level between 0 and 255 is divided into a first range, a second range and a third range, the first critical range is between the first range and the second range, and the second critical range is between the second range and the third range, wherein the first critical range is substantially ranged from 192 to 232 and the second critical range is substantially ranged from 10 to 50; and when the display device is operated in a narrow viewing angle mode, one of the following can be selected:

a) when the on-axis brightness at the gray levels of the first sub-pixel and the second sub-pixel is located in the first range, the ratio of the on-axis brightness at the gray level of the first sub-pixel to the on-axis brightness at the gray level of the second sub-pixel is substantially ranged from 0.3 to 1;

b) when the on-axis brightness at the gray levels of the first sub-pixel and the second sub-pixel is located in the second range, the ratio of the on-axis brightness at the gray level of the first sub-pixels to the on-axis brightness at the gray level of the second sub-pixels is substantially ranged from 0 to 0.3; or c) when the on-axis brightness at the gray levels of the first sub-pixel and the second sub-pixel is located in the third range, the ratio of the on-axis brightness at the gray level of the first sub-pixels to the on-axis brightness at the gray level of the second sub-pixels is substantially ranged from 0.1 to 1.

11. The display device of claim 10, wherein the first range is substantially ranged from 212 to 255, the second range is substantially ranged from 31 to 211, and the third range is substantially ranged from 0 to 30.

12. The display device of claim 10, wherein a sum of the on-axis brightness at the gray levels of the first sub-pixel and the second sub-pixel in any one of the first pixel group and the second pixel group under the narrow viewing angle mode is substantially equal to a sum of the on-axis brightness at the gray levels of the first sub-pixel and the second sub-pixel in any one of the first pixel group and the second pixel group under the wide viewing angle mode.

13. The display device of claim 10, wherein the on-axis brightness at the gray level of the first sub-pixel in any one of the first pixel group and the second pixel group under the narrow viewing angle mode is substantially less than the on-axis brightness at the gray level of the first sub-pixel in any one of the first pixel group and the second pixel group under the wide viewing angle mode.

14. The display device of claim 10, further comprising a first substrate, a second substrate corresponding to the first substrate, and a display medium layer intervened between the first substrate and the second substrate so as to form a panel, such that the first pixel group and the second pixel group in the pixel array are defined on the panel, wherein the first sub-pixel further comprises a third electrode spaced apart from the first electrodes, the third electrode and the first electrodes being disposed in the first sub-pixel on the first substrate, and the second sub-pixel further comprises a fourth electrode spaced apart from the second electrodes, the fourth electrode and the second electrodes being disposed in the second sub-pixel on the first substrate; and a fifth electrode disposed in the first sub-pixel on the second substrate and in the second sub-pixel on the second substrate.

15. The display device of claim 10, wherein each of the electrodes of the first sub-pixel and the second sub-pixel in any one of the first pixel group and the second pixel group has an extending direction, and the extending directions substantially form a V shape.

16. A method for driving a display device with an adjustable viewing angle, comprising:

providing a display device comprising a pixel array at least having a first pixel group and a second pixel group, each of the first and second pixel groups at least comprising a first sub-pixel and a second sub-pixel, wherein the first sub-pixel comprises a plurality of first electrodes which are substantially parallel with each other, and the second sub-pixels comprises a plurality of second electrodes which are substantially parallel with each other, wherein the second electrodes are not parallel to the first electrodes which are substantially parallel with each other;

in a wide viewing angle mode, each of the first and second sub-pixels having an on-axis brightness at a predetermined gray level between 0 and 255, wherein the on-axis brightness at the predetermined gray level between 0 and 255 has a first critical range and a second critical range such that the on-axis brightness at the predetermined gray level between 0 and 255 is divided into a first range, a second range and a third range, the first critical range is between the first range and the second range, and the second critical range is between the second range and the third range, wherein the first critical range is substantially ranged from 192 to 232 and the second critical range is substantially ranged from 10 to 50; and in a narrow viewing angle mode, availably selecting one of the following:

a) when the on-axis brightness at the gray levels of the first sub-pixel and the second sub-pixel is located in the first range, the ratio of the on-axis brightness at the gray level of the first sub-pixel to the on-axis brightness at the gray level of the second sub-pixel is substantially ranged from 0.3 to 1;

b) when the on-axis brightness at the gray levels of the first sub-pixel and the second sub-pixel is located in the second range, the ratio of the on-axis brightness at the gray level of the first sub-pixels to the on-axis brightness at the gray level of the second sub-pixels is substantially ranged from 0 to 0.3; and c) when the on-axis brightness at the gray levels of the first sub-pixel and the second sub-pixel is located in the third range, the ratio of the on-axis brightness at the gray level of the first sub-pixels to the on-axis brightness at the gray level of the second sub-pixels is substantially equal to 0.

17. The method of claim 16, wherein the first range is substantially ranged from 212 to 255, the second range is substantially ranged from 31 to 211, and the third range is substantially ranged from 0 to 30.

18. The method of claim 16, wherein a sum of the on-axis brightness at the gray levels of the first sub-pixels and the second sub-pixel in any one of the first pixel group and the second pixel group under the narrow viewing angle mode is substantially equal to a sum of the on-axis brightness at the gray levels of the first sub-pixel and the second sub-pixel in any one of the first pixel group and the second pixel group under the wide viewing angle mode.

19. The method of claim 16, wherein the on-axis brightness at the gray level of the first sub-pixel in any one of the first pixel group and the second pixel group under the narrow viewing angle mode is substantially less than the on-axis brightness at the gray level of the first sub-pixel in any one of the first pixel group and the second pixel group under the wide viewing angle mode.

20. The method of claim 16, wherein the display device comprises a first substrate, a second substrate corresponding to the first substrate, and a display medium layer intervened between the first substrate and the second substrate so as to form a panel, such that the first pixel group and the second pixel group in the pixel array are defined on the panel, wherein the first sub-pixel further comprises a third electrode spaced apart from the first electrodes, the third electrode and the first electrodes being disposed in the first sub-pixel on the first substrate, and the second sub-pixel further comprises a fourth electrode spaced apart from the second electrodes, the fourth electrode and the second electrodes being disposed in the second sub-pixel on the first substrate; and a fifth electrode disposed in the first sub-pixel on the second substrate and in the second sub-pixel on the second substrate.

21. The method of claim 16, wherein each of the electrodes of the first sub-pixel and the second sub-pixel in any one of the first pixel group and the second pixel group has an extending direction, and the extending directions substantially form a V shape.

22. A method for driving a display device with an adjustable viewing angle, comprising:

providing a display device comprising a pixel array at least having a first pixel group and a second pixel group, each of the first and second pixel groups to at least comprising a first sub-pixel and a second sub-pixel, wherein each of the first sub-pixels comprises a plurality of first electrodes which are substantially parallel with each other, and each of the second sub-pixels comprises a plurality of second electrodes which are substantially parallel with each other, wherein the second electrodes are not parallel to the first electrodes which are substantially parallel with each other;

in a wide viewing angle mode, each of the first and the second sub-pixels having an on-axis brightness at a predetermined gray level between 0 and 255; and in a narrow viewing angle mode, when an on-axis brightness of each of the first and second sub-pixels is less than an on-axis brightness corresponding to a first critical gray level, the on-axis brightness of each the first sub-pixel is an on-axis brightness at a gray level of 0, wherein the first critical gray level is an integer between about 160 and about 220, and when an on-axis brightness of each of the first and second sub-pixels is greater than the on-axis brightness corresponding to the first critical gray level, the on-axis brightness of each the second sub-pixel is an on-axis brightness at a gray level of 255.

* * * * *